US006386292B1

(12) United States Patent
Bland

(10) Patent No.: US 6,386,292 B1
(45) Date of Patent: May 14, 2002

(54) WELLBORE ANNULUS PACKER APPARATUS AND METHOD

(76) Inventor: Linden H. Bland, 2210, 11135-83 Avenue, Edmonton, Alberta (CA), T6G 2C6

( * ) Notice: Subject to any disclaimer, the term of this patent is extended or adjusted under 35 U.S.C. 154(b) by 0 days.

(21) Appl. No.: 09/479,797

(22) Filed: Jan. 10, 2000

(30) Foreign Application Priority Data

Mar. 11, 1999 (CA) ..... 2265223

(51) Int. Cl.[7] ..... E21B 33/12

(52) U.S. Cl. ..... 166/387; 166/386; 166/142; 166/186; 166/210

(58) Field of Search ..... 166/373, 387, 166/386, 142, 147, 185, 186, 194, 210, 330

(56) References Cited

U.S. PATENT DOCUMENTS

| | | | | |
|---|---|---|---|---|
| 2,119,763 | A | | 6/1938 | Wilson |
| 2,849,069 | A | | 8/1958 | Baker |
| 2,965,177 | A | | 12/1960 | Le Bus, Sr. et al. |
| 3,279,542 | A | | 10/1966 | Brown |
| 3,420,305 | A | | 1/1969 | Alexander et al. |
| 3,459,260 | A | | 8/1969 | Dollison |
| 3,467,184 | A | | 9/1969 | Young |
| 3,556,216 | A | | 1/1971 | Condra |
| 3,570,596 | A | | 3/1971 | Young |
| 3,645,334 | A | | 2/1972 | McGill |
| 3,664,417 | A | | 5/1972 | Conrad |
| 3,701,382 | A | | 10/1972 | Williams |
| 3,702,634 | A | * | 11/1972 | Anderson et al. ..... 166/315 |
| 3,705,624 | A | | 12/1972 | Pitts |
| 3,785,436 | A | | 1/1974 | Davis, Jr. |
| 3,861,465 | A | * | 1/1975 | Mignotte ..... 166/255 |
| 3,871,448 | A | | 3/1975 | Vann et al. |
| 3,897,824 | A | | 8/1975 | Fisher |
| 3,931,855 | A | | 1/1976 | Vann et al. |
| 4,071,084 | A | | 1/1978 | Brown et al. |
| 4,146,092 | A | | 3/1979 | Upton |
| 4,151,875 | A | | 5/1979 | Sullaway |
| 4,340,116 | A | | 7/1982 | Weise |
| 4,489,781 | A | | 12/1984 | Weeks |
| 4,496,000 | A | | 1/1985 | Weeks |
| 4,497,366 | A | | 2/1985 | Brieger |
| 4,506,736 | A | | 3/1985 | Evans |
| 4,580,631 | A | | 4/1986 | Baugh |
| 4,582,140 | A | | 4/1986 | Barrington |
| 4,605,062 | A | | 8/1986 | Klumpyan et al. |
| 4,627,491 | A | | 12/1986 | Zunkel |
| 4,669,555 | A | | 6/1987 | Petree |

(List continued on next page.)

FOREIGN PATENT DOCUMENTS

| | | |
|---|---|---|
| CA | 633778 | 1/1962 |
| CA | 1081613 | 7/1980 |
| CA | 1147258 | 5/1983 |
| CA | 1162845 | 2/1984 |
| CA | 1180594 | 1/1985 |
| CA | 1274470 | 9/1990 |
| CA | 1281998 | 3/1991 |

*Primary Examiner*—David Bagnell
*Assistant Examiner*—Zakiya Walker
(74) *Attorney, Agent, or Firm*—Browning Bushman PC

(57) ABSTRACT

A method and an apparatus for connection with a tubing string for use in a wellbore for regulating the flow of a fluid within a wellbore annulus between the tubing string and the wellbore. The apparatus includes a tubing rotator and at least one packer valve for connection with the tubing string, wherein the packer valve is actuatable through rotation of the tubing string by the tubing rotator. Rotation of the tubing string actuates the packer valve between a closed flow position wherein the packer valve substantially seals the wellbore annulus and an open flow position wherein the flow of the fluid is permitted through the wellbore annulus. The method includes the steps of suspending the tubing string in the wellbore by the tubing rotator, connecting the packer valve with the tubing string and rotating the tubing string by the tubing rotator in the first direction to actuate the packer valve to the closed flow position.

26 Claims, 18 Drawing Sheets

U.S. PATENT DOCUMENTS

| | | | |
|---|---|---|---|
| 4,811,785 | A | 3/1989 | Weber |
| 4,901,793 | A | 2/1990 | Weber |
| 5,314,014 | A | 5/1994 | Tucker |
| 5,350,013 | A | 9/1994 | Jani et al. |
| 5,697,449 | A | 12/1997 | Hennig et al. |
| 5,803,178 | A | 9/1998 | Cain |

* cited by examiner

WELLBORE ANNULUS PACKER APPARATUS AND METHOD

FIELD OF INVENTION

The present invention relates to a method and an apparatus for connection with a tubing string for use in a wellbore for regulating the flow of a fluid within a wellbore annulus between the tubing string and the wellbore. Preferably, the invention is used for selective steam injection of a desired hydrocarbon producing zone within an underground formation or for isolating the wellbore annulus to prevent heat loss when injecting down the tubing string.

BACKGROUND OF INVENTION

Wellbore packers are typically suspended in a wellbore from a tubing string or other pipe extending to the surface. These packers are employed for providing a downhole seal between the tubing string and the surrounding wellbore in order to prevent the flow of fluids through an annulus defined between the tubing string and the wellbore. Such packers are desirable for a number of uses, including providing a seal or barrier such that fluid may be selectively injected to or at a desired level in the wellbore to a desired zone within the surrounding formation.

For instance, a zone may be isolated for steaming by pulling the tubing string and installing one or more packer cup along the tubing string at predetermined positions. When top zone steaming of a formation is required, one or more packer cups is installed along the tubing string such that the packer cups are located below the zone to be steam injected when the tubing string is run back into the wellbore. Steam is then directed through the wellbore annulus. The packer cup provides a seal between the tubing string and the wellbore and prevents the steam from passing through the wellbore annulus below the desired zone.

When an intermediate or middle zone is desired to be isolated for steaming, the cups are employed in a straddle application. Specifically, packer cups are installed along the tubing string such that the packer cups are located above and below the zone to be isolated when the tubing string is run back into the wellbore. Further, for steam injection, a perforated joint of pipe is installed between the packer cups. The steam is injected through the tubing string with the downhole pump seated and exits the tubing string through the perforated joint into the wellbore annulus at the desired level. The packer cups again provide a seal between the tubing string and the wellbore and maintain the steam within the desired level of the wellbore annulus such that the steam is directed into the desired zone of the formation.

When the lower or bottom zone is desired to be isolated for steaming, the packer cups are located above the zone to be steamed and the steam is injected through the tubing string with the downhole pump unseated or removed.

In any case, once the formation has been steamed, the tubing string must again be pulled from the wellbore so that the packer cups may be removed. Once removed, a pump is installed and the tubing string is run back into the wellbore to permit production of the well. Specifically, production from all zones is permitted to commingle and flow down to the pump for pumping from the well.

Often in wells that have only one zone, the wells are steamed down the tubing string and a wellbore packer or packer cups are used to prevent steam from entering or refluxing in the wellbore annulus. Steam flow or reflux in the wellbore annulus results in heat loss to the well casing, cement and earth. Again, following steaming, the wellbore packer must be removed for the production cycle in order to allow produced gases to flow up the wellbore annulus.

U.S. Pat. No. 3,701,382 issued Oct. 31, 1972 to Williams, U.S. Pat. No. 3,897,824 issued Aug. 5, 1975 to Fisher, U.S. Pat. No. 4,151,875 issued May 1, 1979 to Sullaway, and U.S. Pat. No. 3,420,305 issued Jan. 7, 1969 to Alexander et. al. each describe a wellbore packer which is fixed in position within the wellbore through release of a releasable connection, and in particular, through shearing of a shearing element. Typically, shearing occurs upon vertical reciprocation of the tubing string.

For example, Williams describes a packer which is held in a retracted position, while lowering into the wellbore, by shearable screws or pins. The screws or pins are sheared when relative upward movement or upstrain of a packer body with respect to the mandrel is effected. To remove the packer, a downward relative movement is applied to move the packer back to the retracted position. However, since the releasable connection, i.e. shear pin, has been broken, further means are required to lock the packer in the locked position. It is thus clear that the packer may not be repeatedly used for multiple operations without removing the packer from the wellbore between uses and replacing the releasable connection.

As indicated, the above described wellbore packers require pulling of the tubing string either to remove the wellbore packer in order to permit fluids to subsequently flow through the wellbore annulus or to replace or refit the wellbore packer for repeated uses. Pulling the tubing string and either replacing or removing the wellbore packer is both time consuming and costly.

Therefore, it is desirable for the packer to be releasable and returnable to an open position to permit multiple operations or uses. In other words, the packer is preferably capable of being both set or closed and unset or opened from the surface for any number of uses without the need to pull the tubing string. In its closed condition, the wellbore annulus is sealed. In its open condition, the packer permits fluid to flow through the wellbore annulus from above the packer to below the packer and vice versa. Further, in its open condition, the packer may be moved to a new desired location in the wellbore, where it may be reset or closed for further use.

As a result, wellbore packers have been developed which provide expandable and retractable packing elements. To seal the wellbore annulus, the packing elements are expanded or extended radially outwards for engagement with the wellbore. More particularly, the packing element is compressed longitudinally within the wellbore to cause lateral expansion of the packing element with sufficient pressure to seal against the wellbore. However, it has been found that after being compressed for an extended period of time that the packing element may not return to its original condition upon release of the longitudinal compression. As a result, the compressed packing element may remain in a sealing condition or it may otherwise interfere with the subsequent passage of fluid through the wellbore and thus, may need to be removed or replaced.

Thus, although these packers may be closed and opened from the surface any number of times as necessary for the desired application, the packer, including the packing element, may impede or otherwise interfere with the flow of fluid through the wellbore annulus. Thus, wellbore packers have been developed which provide a bypass passageway to allow fluid to pass by the packing element. The bypass passageway is typically associated with a bypass valving mechanism for opening and closing the bypass passageway as desired.

However, these bypass passageways tend to be relatively narrow in that the flow paths provided for the fluid flow are too small, which restricts the flow of fluid through the wellbore annulus. Thus, a fully satisfactory response is not provided to the need for a relatively unrestricted flow through the annulus. As well, these relatively small passageways have a tendency to become plugged or clogged by sand and other particulate matter contained within the wellbore fluids.

Further, as indicated, the valving mechanism or structure provided for the bypass passageway is separate from the mechanism or structure provided for actuation of the packing element. In other words, two distinct sealing mechanisms, actuated independently, are provided for the bypass passageway and the packing element. As a result, the overall structure of the packer is relatively complex.

Finally, many wellbore packers which are capable of being selectively opened and closed from the surface are so actuated through manipulation of the tubing string, and specifically, the weight applied through the tubing string to the wellbore packer. These weight setting packers specifically employ the weight of the tubing string above the packer to manipulate the packing elements, and the packer valve associated with the bypass passageway, to a sealed position.

More particularly, these packers tend to be manipulated through longitudinal movement of the tubing string or a combination of longitudinal and rotational movement of the tubing string. As discussed above, the application of sufficient weight to the packing element causes compression of the packing element such that it extends for engagement with the wellbore. Further, the application of sufficient weight causes sealing of the bypass passageway. In addition, the longitudinal and rotational movement are often controlled through the use of a relatively complex structural mechanism, such as a mechanism comprising a J-slot and corresponding lug arrangement.

In any event, difficulties may be encountered in controlling the amount of weight applied through the tubing string to the packing element. The application of excessive weight, particularly for extended periods of time, tends to damage the packing elements and cause longitudinal slippage of the packer within the wellbore. Thus, such packers are often employed in combination with slippage devices for controlling longitudinal movement of the packer within the wellbore. In addition, depending upon the manner of sealing the bypass passageway, this seal may also be subjected to excessive compressive loading, thereby reducing the life of the seal and possibly leading to seal failure.

Examples of these types of wellbore packers are provided by U.S. Pat. No. 3,467,184 issued Sep. 16, 1969 to Young, U.S. Pat. No. 3,570,596 issued Mar. 16, 1971 to Young, U.S. Pat. No. 3,645,334 issued Feb. 29, 1972 to McGill, U.S. Pat. No. 3,785,436 issued Jan. 15, 1974 to Davis, Jr., U.S. Pat. No. 4,071,084 issued Jan. 31, 1978 to Brown et. al., U.S. Pat. No. 4,506,736 issued Mar. 26, 1985 to Evans and U.S. Pat. No. 4,627,491 issued Dec. 9, 1986 to Zunkel.

Each of these examples describes a packer including a tubular body mounted about a mandrel. The tubular body comprises one or more packing elements mounted about an outer surface of the tubular body between a downwardly facing shoulder and an upwardly facing shoulder of the tubular body. Downward movement of the mandrel relative to the tubular body moves the downwardly and upwardly facing shoulders of the tubular body together into closer proximity such that the packing elements are compressed between the shoulders. Compression of the packing elements between the shoulders of the tubular body causes the packing elements to expand radially outward for engagement with the wellbore. Engagement of the packing elements with the wellbore seals the annular space therebetween.

The packer also defines a narrow bypass passageway between an inner surface of the tubular body and the mandrel. A separate downward movement of the tubular body relative to the mandrel results in the coming together or engagement of a seal surface on the mandrel with a seal on the inner surface of the tubular body. Engagement of the seal surface and the seal acts to seal the upper end of the bypass passageway. The bypass passageway may be sealed either before or after the sealing of the wellbore annulus by the packer elements. In either case, the downward weight or compressive force must be maintained in order to maintain the sealing engagement of the packer elements with the wellbore and the sealing engagement of the seal surface with the seal.

Accordingly, each of these patents is not fully satisfactory as each one suffers from one or more of the difficulties or disadvantages discussed above.

Thus, there remains a need in the industry for an improved apparatus for connection with a tubing string for use in a wellbore for regulating the flow of fluid in a wellbore annulus between the tubing string and the wellbore. In particular, there is a need for an improved apparatus capable of being opened and closed from the surface, to either permit flow through or to seal the wellbore annulus respectively, so that pulling of the tubing string from the wellbore is not required. In addition, there is a need for a relatively simple or easily operably mechanism for the actuation of the apparatus from the surface, as compared with known wellbore packers.

Further, there is a need for the apparatus to permit flow through the wellbore annulus relatively unrestricted or unimpeded as compared with other wellbore packers when the apparatus is in the open position. In other words, there is a need for an apparatus which provides for bypassing of the apparatus in a manner which does not significantly interfere with or impede the flow of the fluid between a position above the apparatus and a position below the apparatus in the wellbore.

SUMMARY OF INVENTION

The present invention relates to an apparatus for connection with a tubing string for use in a wellbore for regulating the flow of fluid in a wellbore annulus between the tubing string and the wellbore. In addition, the present invention relates to a method for regulating the flow of a fluid in the wellbore annulus. The method is preferably performed using the apparatus of the within invention.

The apparatus is comprised of at least one packer valve for regulating the flow through the wellbore annulus. Although the apparatus and the packer valve may be used for any application in which the flow of fluid through the wellbore annulus requires regulation, such as for isolating the perforations while hot oiling or de-waxing of the tubing string, the within invention is particularly suited for use in the steam injection of a hydrocarbon producing formation. More particularly, the apparatus may be used for isolating a particular desired zone of the formation so that the desired zone is selectively steamed during performance of the steaming operation.

Where an upper zone or a lower zone of the formation is to be steamed, the apparatus comprises the packer valve as described herein. Alternately, the apparatus may comprise two packer valves and a tubing valve connected together in series such that the tubing valve is located therebetween. In this configuration, the apparatus is particularly useful for isolating a middle or intermediate zone of the formation so that the intermediate zone may be selectively steamed during the steaming operation.

In particular, the apparatus may also be used to isolate all of the wellbore annulus above the desired zone to be steamed in order to keep steam out of this annulus, thus reducing heat loss to the wellbore wall, casing wall or surrounding cement and earth.

In any case, the apparatus is preferably capable of being actuated from the surface so that pulling of the tubing string from the wellbore is not required to operate the apparatus. More particularly, the packer valve of the apparatus is preferably movable between an open flow position, permitting flow through the wellbore annulus, and a closed flow position, regulating or restricting the flow of fluid through the annulus. The packer valve may be moved or actuated between the open and closed flow positions in any manner and by any mechanism or structure permitting the operation of the packer valve from the surface. However, preferably, the packer valve is actuated through the tubing string. Specifically, the packer valve is preferably connectable to the tubing string such that the packer valve is manipulable, and actuatable, through manipulation of the tubing string.

The tubing string may be manipulated in any manner to actuate the packer valve. For instance, the tubing string may be longitudinally or axially moved in the wellbore in either an upwards or downwards direction. However, preferably, the tubing string is rotated at the surface to actuate the apparatus. The tubing string may be rotated by any device, mechanism or method, including manual rotation, able to rotate the tubing string in the wellbore in the desired direction of rotation. However, preferably, the tubing string is rotated by a tubing rotator provided at the surface for rotating the tubing string within the wellbore. Any tubing rotator able to rotate the tubing string within the wellbore may be used for this purpose.

Further, the apparatus, including the packer valve, preferably permits a flow of fluid through the wellbore annulus relatively unrestricted or unimpeded as compared with other wellbore packers when the packer valve is in the open flow position. Specifically, the packer valve provides a fluid flow path for bypassing the packer valve which restricts or impedes the flow of the fluid through the wellbore annulus in a relatively less substantial manner or in a relatively lesser degree as compared to other wellbore packers.

In particular, the packer valve preferably defines an outer annular space between the packer valve and the wellbore when positioned in the wellbore and an inner annular space. In the open flow position, the outer annular space communicates with the inner annular space to provide the fluid flow path between a position above the packer valve and a position below the packer valve. In the closed flow position, communication between the outer and inner annular spaces is restricted to regulate the flow through the fluid flow path or between the inner and outer annular spaces.

The invention is comprised of an apparatus for connection with a tubing string for use in a wellbore for regulating the flow of a fluid within a wellbore annulus between the tubing string and the wellbore. In a first aspect of the invention in its apparatus form, the apparatus is comprised of:

(a) a tubing rotator for rotating the tubing string within the wellbore; and (b) at least one packer valve for connection with the tubing string, wherein the packer valve is actuatable through rotation of the tubing string by the tubing rotator;

wherein rotation of the tubing string by the tubing rotator actuates the packer valve between a closed flow position wherein the packer valve substantially seals the wellbore annulus and an open flow position wherein the flow of the fluid is permitted through the wellbore annulus.

The tubing rotator may be comprised of any tubing rotator able to rotate the tubing string within the wellbore as required to actuate the packer valve. Further, in this aspect of the apparatus, the packer valve may be comprised of any packer valve able to regulate the flow of fluid through the wellbore annulus, which is able to be connected downhole with the tubing string and which is actuatable through rotation.

Preferably, rotation of the tubing string in a first direction actuates the packer valve to the closed flow position and rotation of the tubing string in a second opposed direction actuates the packer valve to the open flow position. In addition, the packer valve is preferably comprised of:

(a) a packer body for connection with the tubing string such that the packer body is actuatable through rotation of the tubing string by the tubing rotator, wherein the packer body has a longitudinal bore extending therethrough for communication with the tubing string;

(b) an inner packing member associated with the packer body such that the inner packing member extends radially outwardly from the packer body, wherein an outer annular space is defined between the inner packing member and the wellbore when the packer valve is positioned in the wellbore;

(c) an outer packing member associated with the packer body such that the outer packing member is movable axially relative to the inner packing member upon rotation of the tubing string, wherein the outer packing member is a spaced radial distance from the packer body to define an inner annular space therebetween for bypassing the outer packing member;

wherein the outer packing member is movable axially relative to the inner packing member between the closed flow position wherein the outer packing member is engaged with the inner packing member and the wellbore to substantially seal the outer annular space and the inner annular space and the open flow position wherein the outer packing member is disengaged from at least the inner packing member and the outer annular space communicates with the inner annular space to permit the flow of the fluid through the outer annular space and the inner annular space.

In a second aspect of the invention in its apparatus form, the apparatus comprises at least one packer valve. In this aspect of the invention, the packer valve comprises:

(a) a packer body for connection with the tubing string such that the packer body is manipulable through manipulation of the tubing string, wherein the packer body has a longitudinal bore extending therethrough for communication with the tubing string;

(b) an inner packing member associated with the packer body such that the inner packing member extends radially outwardly from the packer body, wherein an outer annular space is defined between the inner packing member and the wellbore when the packer valve is positioned in the wellbore;

(c) an outer packing member associated with the packer body such that the outer packing member is movable axially relative to the inner packing member, wherein the outer packing member is a spaced radial distance from the packer body to define an inner annular space therebetween for bypassing the outer packing member;

wherein the inner packing member is movable axially relative to the outer packing member between a closed flow position wherein the outer packing member is engaged with the inner packing member and the wellbore to substantially seal the outer annular space and the inner annular space and an open flow position wherein the outer packing member is disengaged from at least the inner packing member and the outer annular space communicates with the inner annular space to permit the flow of the fluid through the outer annular space and the inner annular space.

In the second aspect of the apparatus, the packer valve may be actuated by manipulation of the tubing string in any manner, such as by longitudinal movement of the tubing string resulting in a longitudinal or axial movement of the inner packing member relative to the outer packing member. Specifically, longitudinal movement of the tubing string in a first direction may cause the inner packing member to move axially relative to the outer packing member towards the closed flow position, while longitudinal movement in an opposed second direction may cause the inner packing member to move axially relative to the outer packing member towards the open flow position.

However, preferably in both the first and second aspects of the invention, the packer valve is actuated by rotation of the tubing string. Specifically, rotation of the tubing string in a first direction causes the inner packing member to move axially relative to the outer packing member towards the closed flow position and rotation of the tubing string in a second opposed direction causes the inner packing member to move axially relative to the outer packing member towards the open flow position. More particularly, rotation of the tubing string rotates the inner packing member relative to the outer packing member and rotation of the inner packing member relative to the outer packing member is translated into axial movement of the inner packing member relative to the outer packing member.

In the first and second aspects, the inner packing member may be comprised of any packing device, element or structure, and may have any shape or configuration, able to sealingly engage the outer packing member. Similarly, the outer packing member may be comprised of any packing, device, element or structure, and may have any shape or configuration, able to sealingly engage the inner packing member and the wellbore. Further, the inner and outer packing members are preferably shaped or configured to maximize a radial dimension of the outer annular space and a radial dimension of the inner annular space respectively.

The inner and outer annular spaces may each have any radial dimension which permits the necessary engagement of the inner packing member and the outer packing member and the necessary engagement of the outer packing member and the wellbore. Further, the inner and outer annular spaces may have any relative radial dimensions. In the preferred embodiment, the radial dimension of the outer annular space is about equal to the radial dimension of the inner annular space in the open flow position.

Further, the inner packing member and the outer packing member define a location of contact in the closed flow position. Preferably, in the closed flow position the inner packing member overlaps with the outer packing member. In other words, an outer surface of the inner packing member and an inner surface of the outer packing member engage such that the location of contact therebetween has a radial dimension. In the preferred embodiment, the radial dimension of the location of contact is minimized while still permitting the sealing engagement therebetween. Minimization of the radial dimension of the location of contact assists in the maximization of the radial dimensions of the inner and outer annular spaces.

Although the outer packing member may have any shape or configuration and may sealingly engage the inner packing member and the wellbore in any manner, the outer packing member preferably comprises a first surface for sealingly engaging the wellbore and a second surface for sealingly engaging the inner packing member in the closed flow position. Further, the engagement of the second surface of the outer packing member with the inner packing member preferably moves the outer packing member radially outwardly to sealingly engage the first surface of the outer packing member with the wellbore.

Further, the sealing engagement between the inner and outer packing members and between the outer packing member and the wellbore may be accomplished by one or more sealing members located between the respective surfaces. Specifically, at least one sealing member is preferably associated with the first surface of the outer packing member for sealingly engaging the wellbore and at least one sealing member is preferably associated with at least one of the second surface of the outer packing member and the inner packing member for sealingly engaging the inner packing member and the outer packing member. Each sealing member may be comprised of any seal, sealing device, mechanism or structure.

The packer body may be comprised of any type and number of elements or members permitting the association of the inner and outer packing members therewith in the manner described. In addition, each of the inner and outer packing members may be associated with the packer body by any manner of connection or mounting permitting the relative axial movement therebetween between the open flow and closed flow positions.

However, preferably, the packer body is comprised of a packer mandrel for connection with the tubing string such that the packer mandrel is rotatable through rotation of the tubing string. The packer mandrel has an outer surface and a longitudinal bore extending therethrough for communication with the tubing string. Preferably, the inner packing member is mounted about the packer mandrel such that the inner packing member extends radially outwardly from the outer surface of the packer mandrel.

In addition, the packer valve is preferably further comprised of a packer sleeve mounted about the packer mandrel such that rotation of the packer mandrel relative to the packer sleeve is translated into axial movement of the packer mandrel relative to the packer sleeve. Further, the outer packing member is mounted with the packer sleeve so that the inner packing member is movable axially relative to the outer packing member upon axial movement of the packer mandrel relative to the packer sleeve.

Any structure or mechanism may be used for translating the relative rotational movement into relative axial movement. In the preferred embodiment, the outer surface of the packer mandrel comprises an outer threaded portion and the packer sleeve has an inner surface comprising an inner threaded portion. The outer threaded portion of the packer mandrel is engaged with the inner threaded portion of the packer sleeve such that rotation of the packer mandrel relative to the packer sleeve is translated into axial movement of the packer mandrel relative to the packer sleeve.

In order to facilitate the relative rotation between the inner packing member and the outer packing member, the apparatus is preferably further comprised of a drag member associated with the outer packing member for engaging the wellbore to inhibit rotation of the outer packing member within the wellbore upon rotation of the inner packing member. The drag member may be a separate unit or element from the outer packing member or it may be integrally formed with the outer packing member to form a single unit or unitary member. Further, it may be associated with the outer packing member in any manner permitting it to inhibit the rotation of the outer packing member within the wellbore. In the preferred embodiment, both the outer packing member and the drag member are mounted with the packer sleeve.

Any drag member or drag structure able to inhibit the rotation of the packer sleeve may be used. For instance, the drag member may be comprised of one or more bow springs extended from the packer sleeve for engagement with the wellbore. However, in the preferred embodiment, the drag member is comprised of a plurality of drag blocks having an inner surface and an outer surface for engaging the wellbore and at least one spring associated with the inner surface of each drag block for urging the drag block radially outward such that the outer surface is urged into engagement with the wellbore. Further, each drag block may be pivotable to a binding position upon the rotation of the inner packing member relative to the outer packing member in the first direction in order to prevent rotation of the outer packing member within the wellbore. Further, the drag block may be associated with a cam surface of the inner packing member which will urge the drag block into engagement with the wellbore.

In addition, the apparatus may be further comprised of a tubing valve for permitting fluid to flow between the longitudinal bore of the packer body, and in particular the longitudinal bore of the packer mandrel, and the wellbore annulus. The tubing valve may be actuated in any manner and by any mechanism or structure. Preferably, the tubing valve is actuatable from the surface and more preferably, is actuatable through manipulation of the tubing string, and more preferably, through rotation of the tubing string. As well, the tubing valve is preferably open when the packer valve is in the closed flow position and is preferably closed when the packer valve is in the open flow position.

Preferably, axial movement of the inner packing member relative to the outer packing member to the closed flow position opens the tubing valve to permit the passage of fluid therethrough and axial movement of the inner packing member relative to the outer packing member to the open flow position closes the tubing valve to prevent the passage of fluid therethrough. In the preferred embodiment, axial movement of the packer mandrel relative to the packer sleeve to the closed flow position opens the tubing valve, while axial movement of the packer mandrel relative to the packer sleeve to the open flow position closes the tubing valve.

The tubing valve may be comprised of any valve or valving device able to selectively permit and restrict the flow of the fluid therethrough. In the preferred embodiment, the tubing valve is comprised of a tubing mandrel and a tubing valve. The tubing mandrel has a longitudinal bore extending therethrough and is connected with the packer mandrel such that the longitudinal bore of the tubing mandrel communicates with the longitudinal bore of the packer mandrel and such that axial movement of the packer mandrel causes axial movement of the tubing mandrel. The tubing mandrel defines at least one mandrel aperture therethrough for the passage of fluid from the longitudinal bore.

The tubing sleeve is mounted about the tubing mandrel such that the tubing mandrel is movable axially relative to the tubing sleeve. Further, the tubing sleeve is connected to the packer sleeve such that axial movement of the packer sleeve causes axial movement of the tubing sleeve. The tubing sleeve defines at least one sleeve aperture therethrough for the passage of fluid which is communicable with the mandrel aperture upon the axial alignment of the mandrel aperture and the sleeve aperture. Movement of the packer valve towards the closed flow position axially aligns the mandrel aperture and the sleeve aperture to permit the passage of fluid therethrough, while movement of the packer valve towards the open flow position axially misaligns the mandrel aperture and the sleeve aperture to inhibit the passage of fluid therethrough.

Finally, the apparatus may be comprised of two packer valves connected together in series with the tubing valve such that the tubing valve is located therebetween. Preferably, rotation of the tubing string in the first direction causes each of the packer valves to move towards the closed flow position while the tubing valve is moved towards an open position and rotation of the tubing string in the second direction causes each of the packer valves to move towards the open flow position while the tubing valve is moved towards a closed position.

In addition, the invention is comprised of a method for regulating the flow of a fluid in a wellbore within a wellbore annulus between a tubing string and the wellbore. In a first aspect of the invention in its method form, the method is for use with a tubing rotator for rotating the tubing string within the wellbore and the method is comprised of the steps of:

(a) rotatably suspending the tubing string in the wellbore;

(b) connecting at least one packer valve with the tubing string, wherein the packer valve is actuatable through rotation of the tubing string between a closed flow position wherein the packer valve substantially seals the wellbore annulus and an open flow position wherein the flow of the fluid is permitted through the wellbore annulus; and (c) rotating the tubing string by the tubing rotator in a first direction to actuate the packer valve to the closed flow position.

In this first aspect, the method may further comprise the step of rotating the tubing string in a second opposed direction to actuate the packer valve to the open flow position.

In a second aspect of the invention in its method form, the method is comprised of the steps of:

(a) providing at least one packer valve comprising a packer body, an inner packing member and an outer packing member;

(b) suspending the packer body from the tubing string such that the packer body is manipulable through manipulation of the tubing string, wherein the packer body has a longitudinal bore extending therethrough for communication with the tubing string and wherein the inner packing member is associated with the packer body such that the inner packing member extends radially outwardly from the packer body, wherein an outer annular space is defined between the inner packing member and the wellbore when the packer valve is positioned in the wellbore;

(c) mounting the outer packing member with the packer body such that the outer packing member is movable axially relative to the inner packing member, wherein the outer packing member is a spaced radial distance from the packer body to define an inner annular space therebetween for bypassing the outer packing member;

(d) first moving the inner packing member axially towards the outer packing member to a closed flow position wherein the outer packing member is engaged with the inner packing member and the wellbore to substantially seal the outer annular space and the inner annular space.

In this second aspect, the method may further comprise the step of second moving the inner packing member axially away from the outer packing member to an open flow position wherein the outer packing member is disengaged from at least the inner packing member and the outer annular space communicates with the inner annular space to permit the flow of the fluid through the outer annular space and the inner annular space.

In the first aspect, the tubing string is rotated in order to actuate the packer valve. In the second aspect, the first and second moving steps require the axial movement of the inner packing member relative to the outer packing member. This relative axial movement may be accomplished in any manner, such as through longitudinal or axial movement of the tubing string, through a rotary movement of the tubing string or through a combination thereof. However, preferably, the first and second moving steps are accomplished through rotation of the tubing string.

Specifically, the first moving step is preferably comprised of:

(a) rotating the tubing string in a first direction to rotate the inner packing member in the first direction relative to the outer packing member; and (b) translating the rotation of the inner packing member relative to the outer packing member into axial movement of the inner packing member relative to the outer packing member towards the closed flow position.

Further, the second moving step is preferably comprised of:

(a) rotating the tubing string in a second direction to rotate the inner packing member in the second direction relative to the outer packing member; and (b) translating the rotation of the inner packing member relative to the outer packing member into axial movement of the inner packing member relative to the outer packing member towards the open flow position.

Preferably, the method further comprises the step of inhibiting the rotation of the outer packing member within the wellbore during rotation of the tubing string in the first direction to facilitate rotation of the inner packing member relative to the outer packing member. More preferably, the method comprises the step of inhibiting the rotation of the outer packing member within the wellbore during rotation of the tubing string in the first direction and the second direction to facilitate rotation of the inner packing member relative to the outer packing member.

In addition, the method may further comprise of the steps of:

(a) providing a tubing valve for permitting fluid to flow between the longitudinal bore of the packer body and the wellbore annulus;

(b) opening the tubing valve to permit the flow of the fluid therethrough upon movement of the packer valve to the closed flow position; and (c) closing the tubing valve to inhibit the passage of the fluid therethrough upon movement of the packer valve to the open flow position.

Finally, the method may be comprised of providing two packer valves connected together in series with the tubing valve such that the tubing valve is located therebetween, wherein rotating the tubing string in the first direction causes each of the packer valves to move towards the closed flow position while the tubing valve is moved towards an open position and rotating the tubing string in the second direction causes each of the packer valves to move towards the open flow position while the tubing valve is moved towards a closed position.

As indicated above, the method is preferably performed using the apparatus, and in particular, the elements or components of the apparatus as described above. However, any other suitable apparatus, or elements or components of it, may be used which permit the performance of the method as described herein.

BRIEF DESCRIPTION OF DRAWINGS

Embodiments of the invention will now be described with reference to the accompanying drawings, in which.

DETAILED DESCRIPTION

Figure 1:
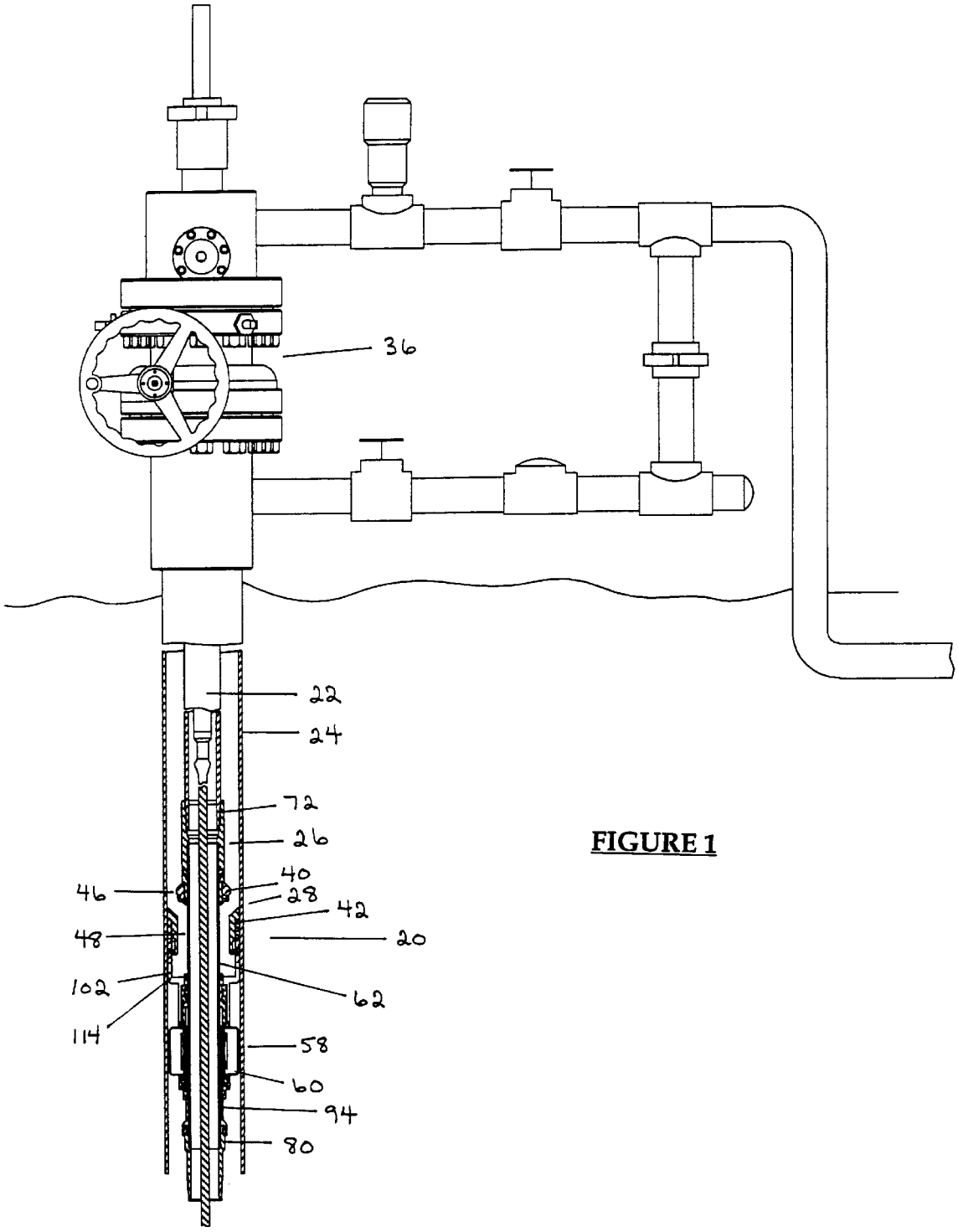
FIG. 1 is a side view of a wellhead including a tubing rotator for rotating a tubing string within a wellbore.
Figure 2A:
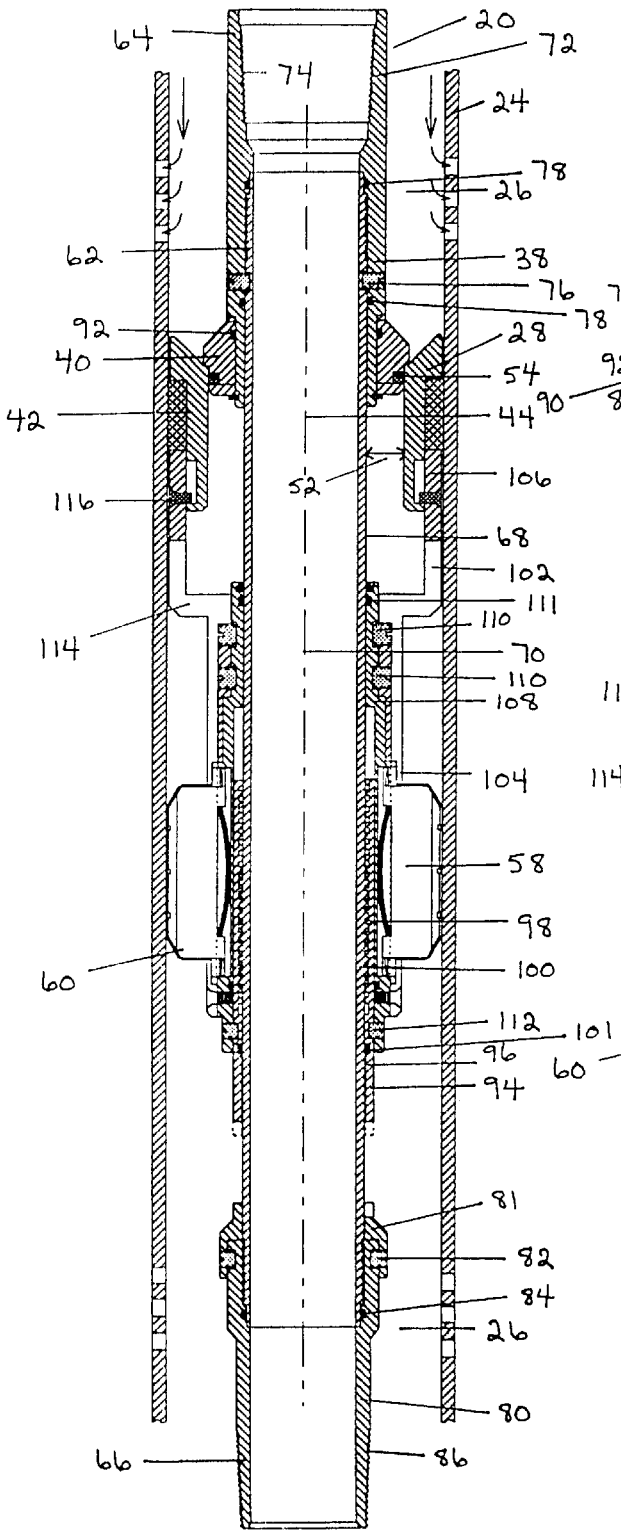
FIGS. 2(*a*) and 2(*b*) are longitudinal sectional views of a first embodiment of an apparatus of the within invention comprising a packer valve contained within the wellbore in a closed flow position and an open flow position respectively, wherein the first embodiment is shown for particular use in steam injection of a top or upper zone of a desired underground formation.
Figure 2B:
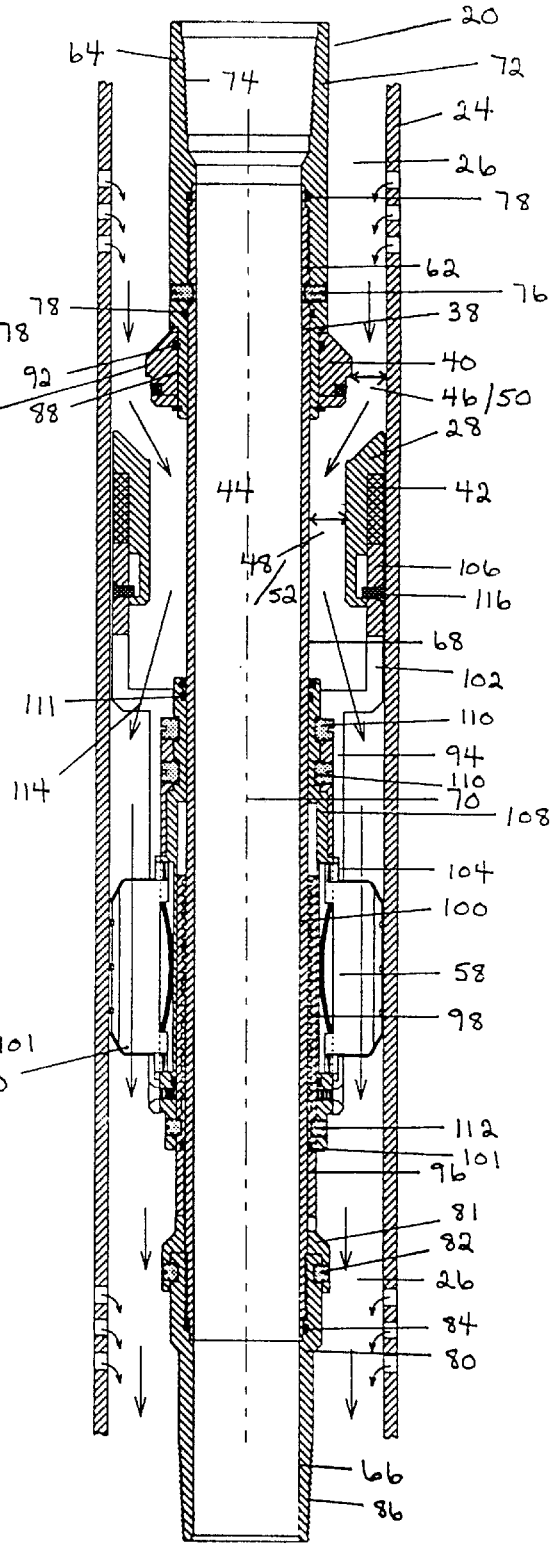
Figure 10A:
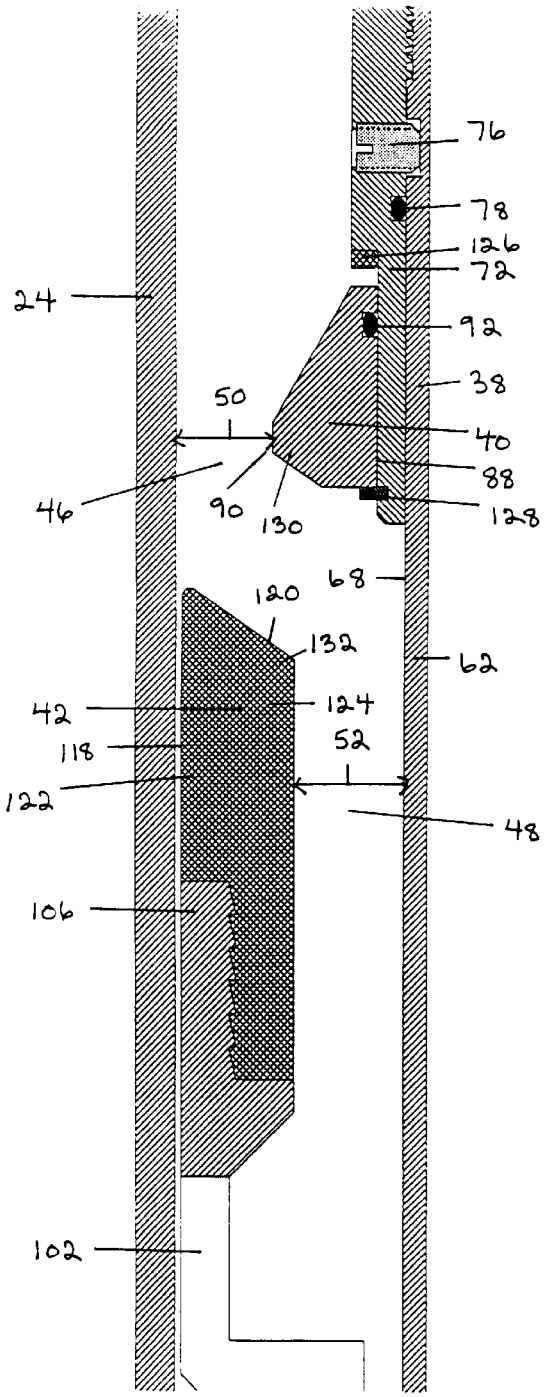
FIGS. 10(*a*) and 10*b*) are detailed longitudinal sectional views of a further alternate embodiment of the inner packing member and the outer packing member, shown in the open flow position and closed flow position respectively.
Figure 10B:
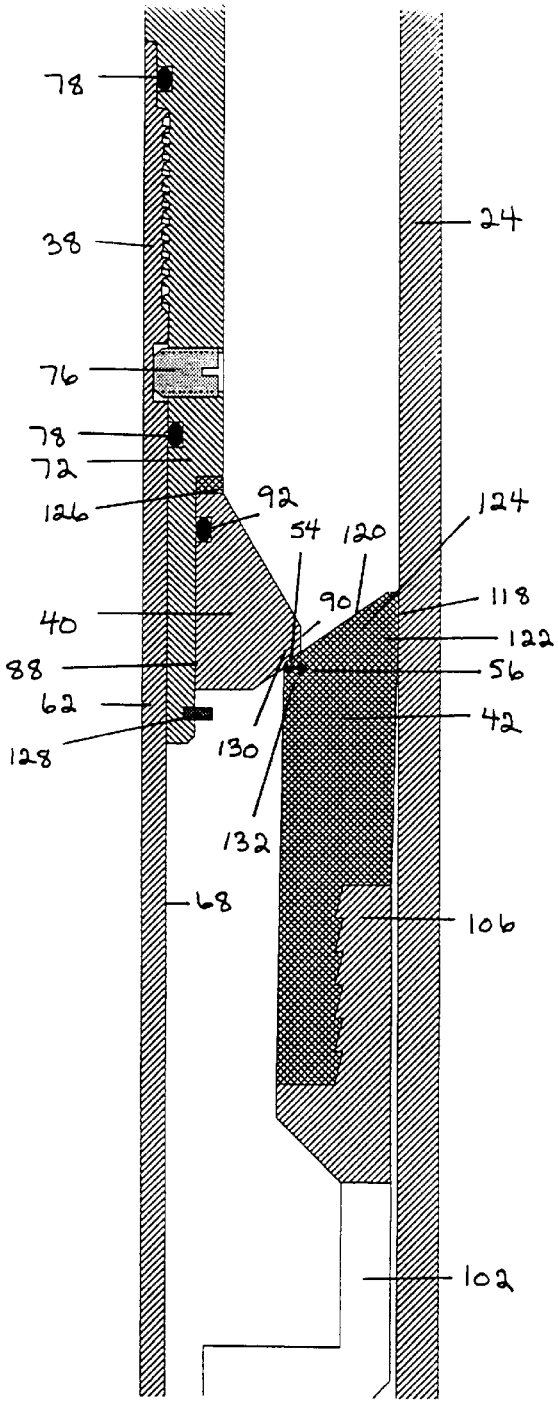

Referring to FIGS. 1, 2 and 10, the invention is comprised of a method and an apparatus (20) for connection with a tubing string (22) for use in a wellbore (24). Specifically, the apparatus (20) is provided in the wellbore (24) for regulating the flow of a fluid within a wellbore annulus (26) between the tubing string (22) and the wellbore (24). The apparatus (20) is comprised of at least one packer valve (28) for connection with the tubing string (22).

The packer valve (28) may be connected with any tubing string (22) extending downhole from the surface within the wellbore (24) so that the packer valve (28) is located within the wellbore (24). Further, the packer valve (28) may be connected with the tubing string (22) in any manner permitting the operation of the apparatus (20) and the actuation of the packer valve (28) through the manipulation of the tubing string (22) as described further below.

Further, the apparatus (20) may be used for regulating the flow of fluid through the wellbore annulus (26) in either direction. In other words, the apparatus (20) may regulate the flow of fluid through the wellbore annulus (26) in a downhole direction, towards the bottom of the wellbore (24), or in an uphole direction, towards the surface. In either case, the packer valve (28) selectively permits or restricts the flow of the fluid past the packer valve (28) through the wellbore annulus (26). Thus, the packer valve (28) restricts or regulates the flow of fluid between a position above the packer valve (28) and a position below the packer valve (28).

The wellbore annulus (26) is defined between the tubing string (22) and the wellbore (24). Preferably, the wellbore (24) is cased or lined so that the wellbore annulus (26) is defined between the tubing string (22) and the casing or lining of the wellbore (24). In addition, when using the apparatus (20) in a steam injection application, the casing or lining is preferably slotted or otherwise permits the passage of fluids therethrough so that the steam may be injected from the wellbore annulus (26) into the adjacent zone to be steam injected.

Although the within invention may be used for any application, such as for isolating the perforations while hot oiling or de-waxing the tubing string (22) or for isolating the wellbore annulus (26) to prevent heat loss when injecting steam down the tubing string (22), it is preferably used for isolating a desired zone within a hydrocarbon producing formation for steam injection. Depending upon the location of the particular zone desired to be steamed, the particular configuration of the packer valve (28) may vary. In addition, the apparatus (20) may comprise further components.

Figure 8A:
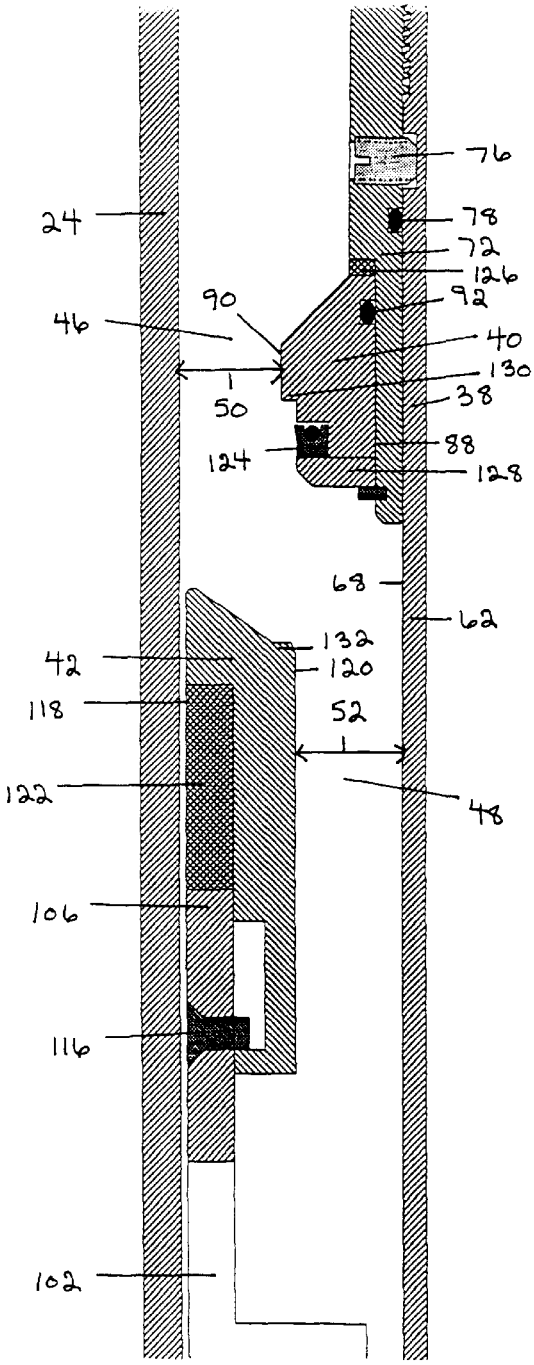
FIGS. 8(*a*) and 8(*b*) are detailed longitudinal sectional views of an inner packing member and an outer packing member comprising the packer valve shown in FIG. 4, shown in the open flow position and closed flow position respectively.
Figure 8B:
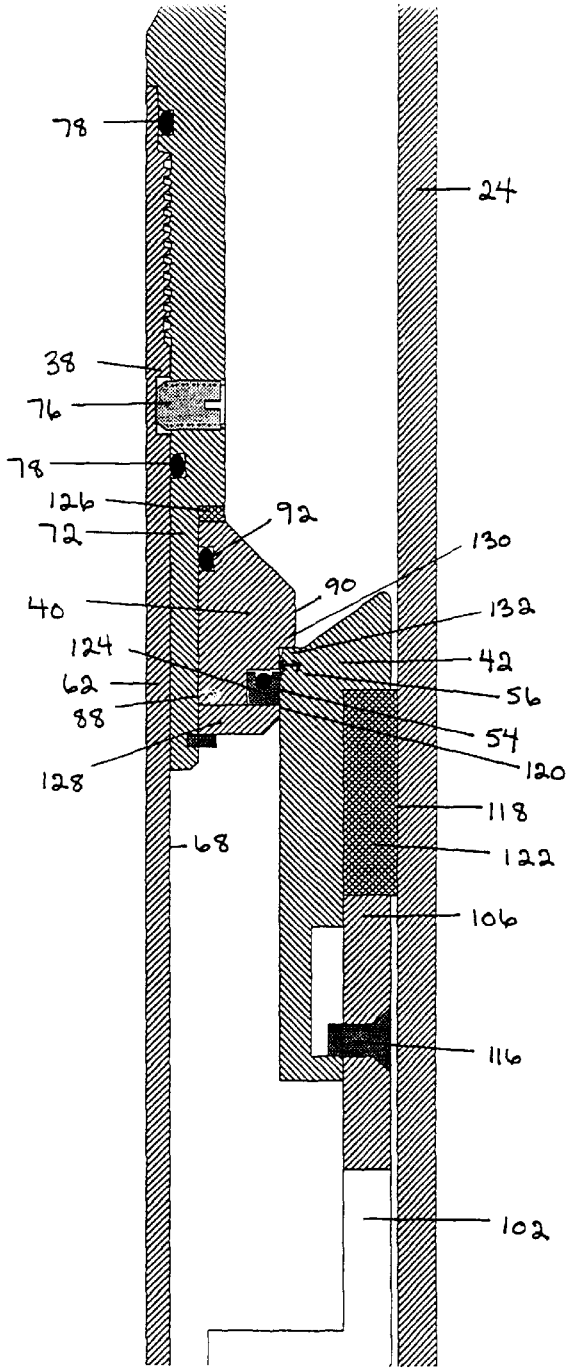

For instance, the embodiment of the apparatus (20) shown in FIGS. 2 through 10 is preferably used for isolating a top or upper zone of the formation so as to steam down the wellbore annulus (26) or for isolating a bottom or lower zone of the formation so as to steam down the tubing string (22) with the downhole pump unseated. Further, although the specific configuration of the packer valve (28) for this application may vary, as discussed further below, the packer valve (28) is preferably a "packer-type valve" as shown in FIGS. 8(*a*) and (*b*). The packer-type valve may provide a more positive seal on the rough inner surface of old casing comprising the wellbore (24).

Figure 11A:
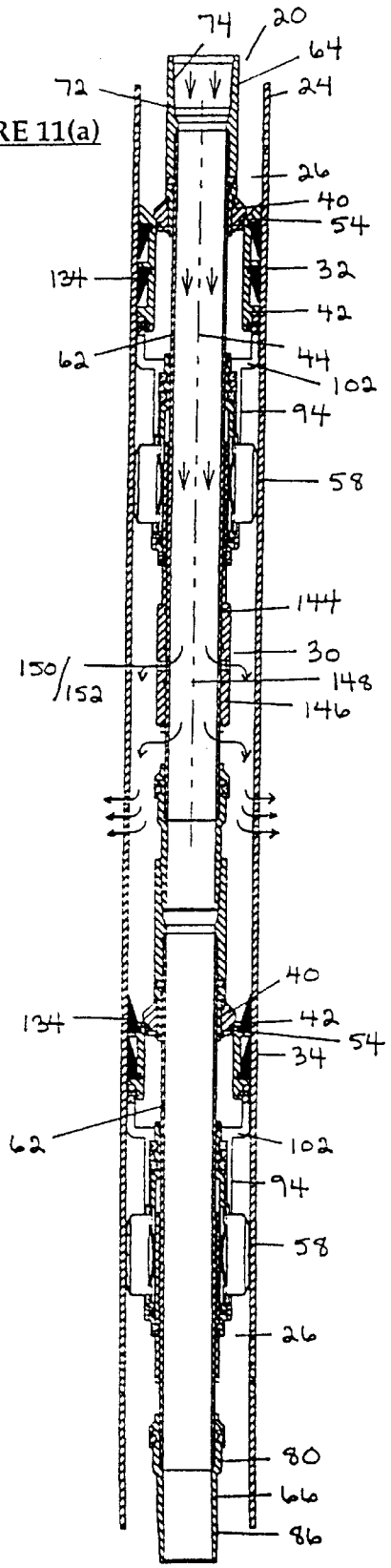
FIGS. 11(*a*) and 11(*b*) are longitudinal sectional views of a second embodiment of the apparatus of the within invention comprising an upper packer valve, a lower packer valve and a tubing valve contained within the wellbore, wherein the packer valves are shown in a closed flow position and an open flow position respectively and wherein the second embodiment of the apparatus is shown for particular use in a straddle application for steam injection of an intermediate zone of a desired underground formation.
Figure 11B:
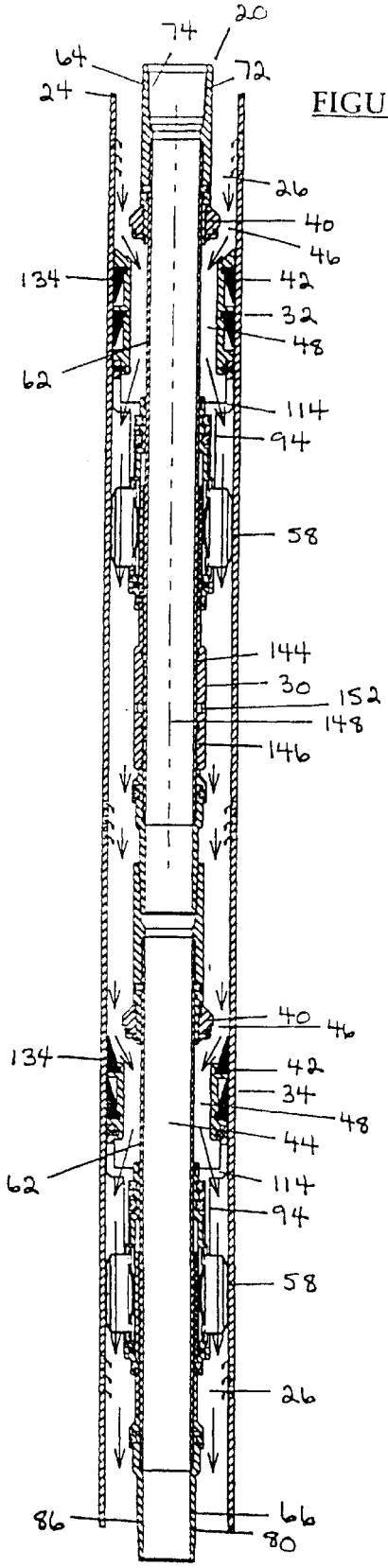
Figure 12A:
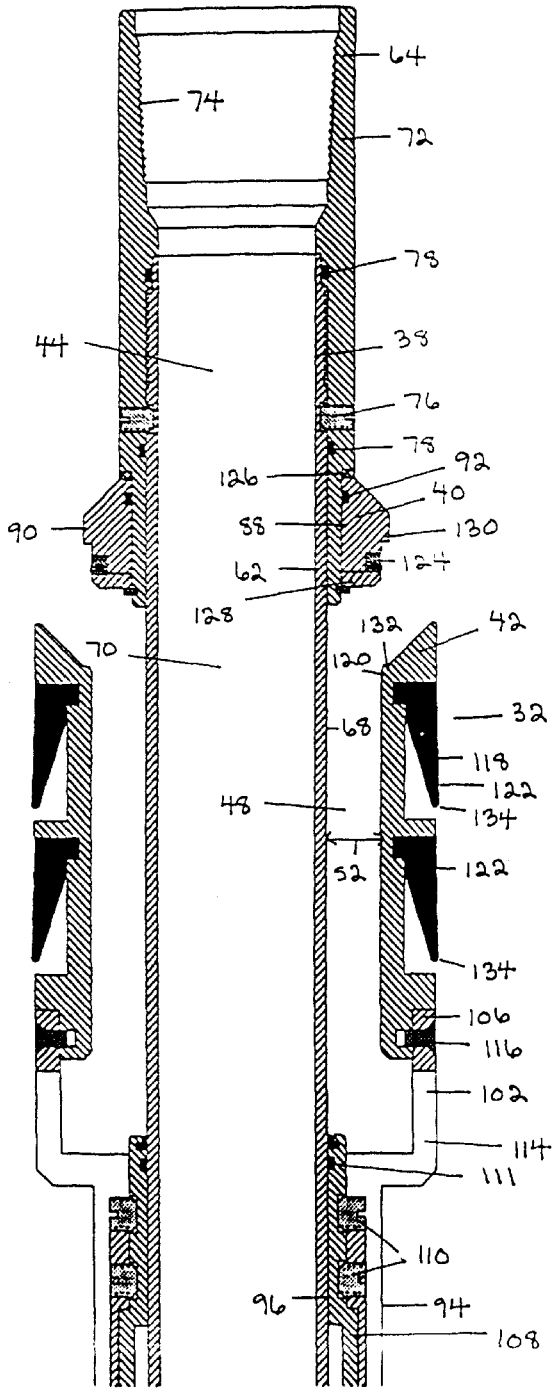
FIGS. 12(*a*) and 12(*b*) are detailed longitudinal sectional views of the upper packer valve and the tubing valve shown in FIG. 11(*b*), wherein FIG. 12(*b*) is a lower continuation of FIG. 12(*a*)
Figure 12B:
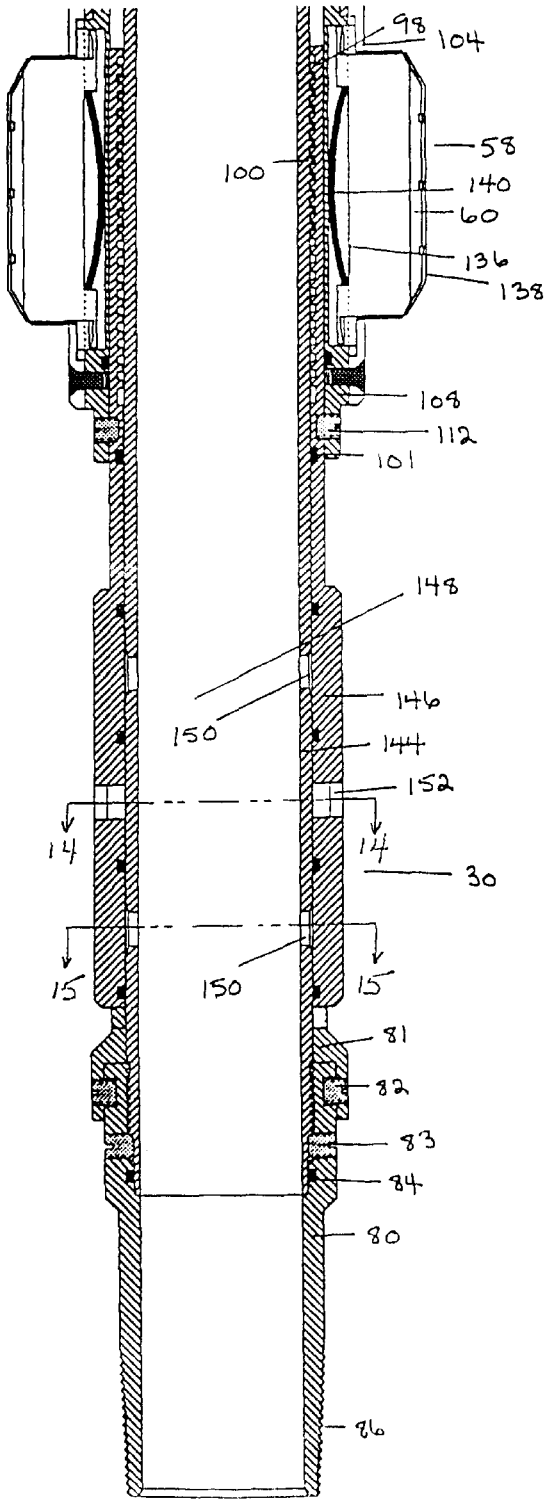
Figure 13A:
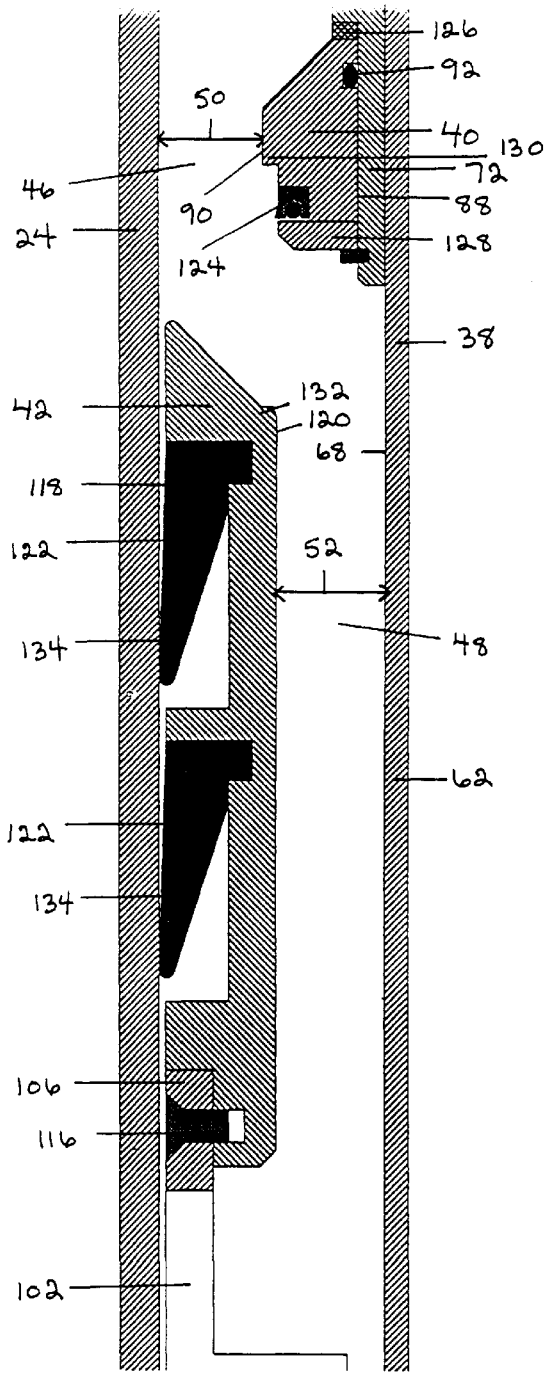
FIGS. 13(*a*) and 13(*b*) are detailed longitudinal sectional views of an inner packing member and an outer packing member comprising the upper packer valve shown in FIG. 12(*a*), shown in the open flow position and closed flow position respectively.
Figure 13B:
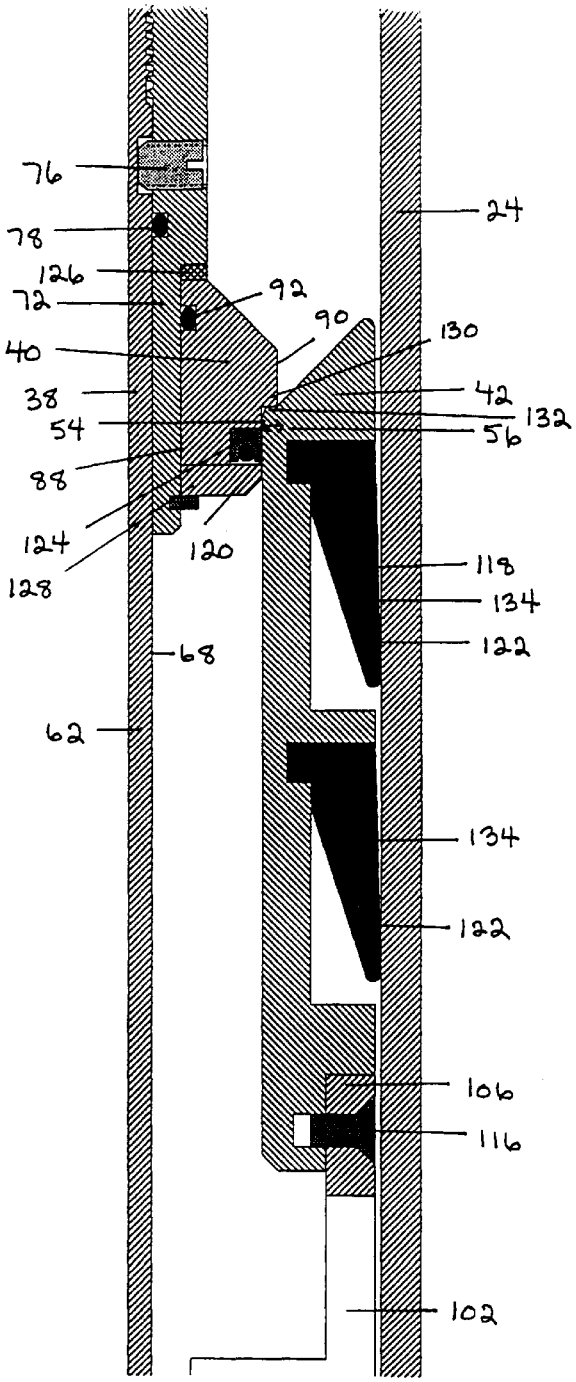
Figure 14:
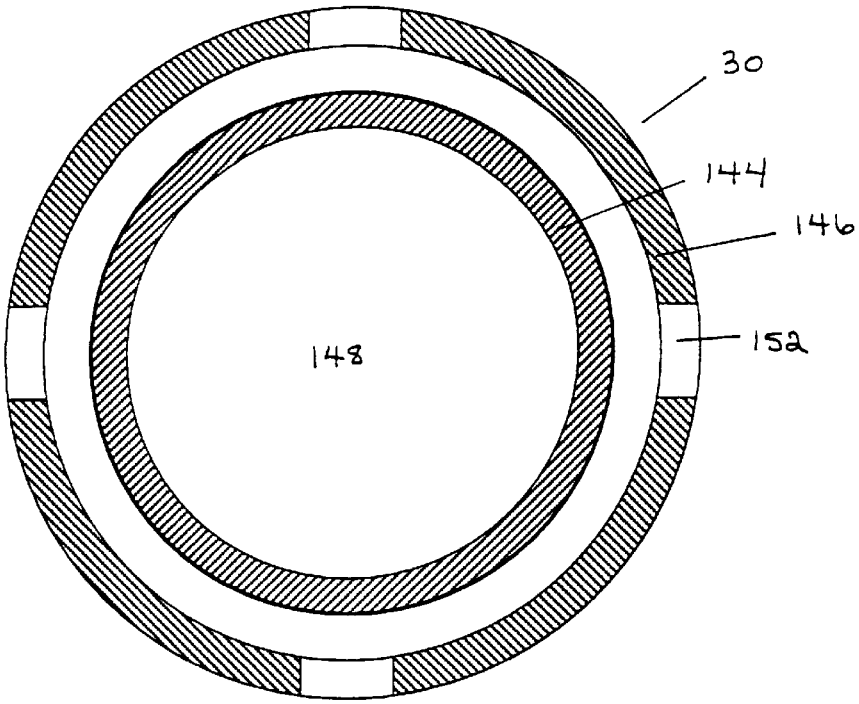
FIG. 14 is a cross-section of the tubing valve taken along line 14—14 of FIG. 12(*b*)
Figure 15:
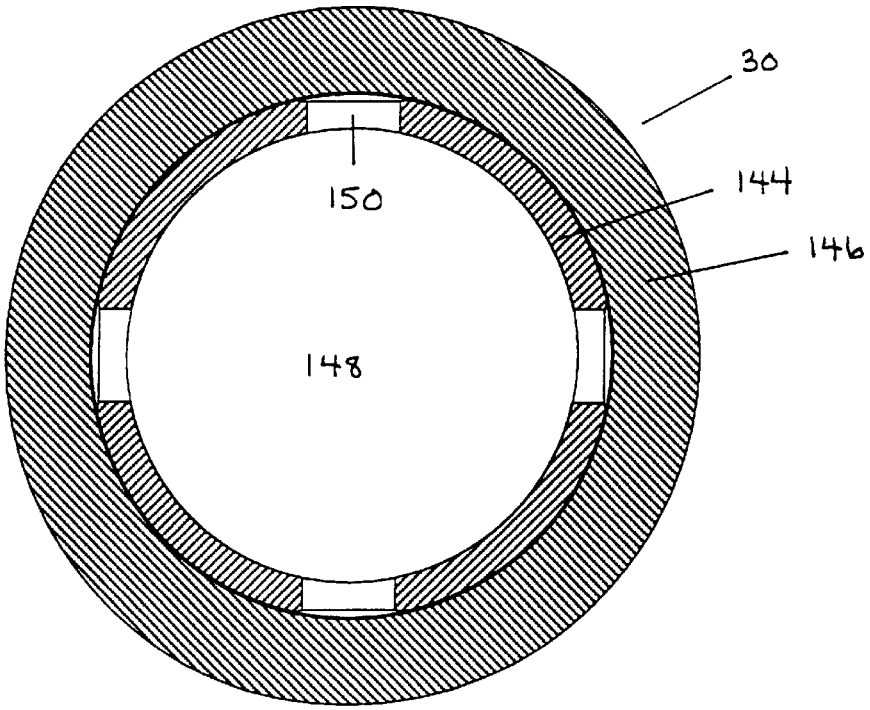
FIG. 15 is a cross-section of the tubing valve taken along line 15—15 of FIG. 12(*b*)
Figure 16A:
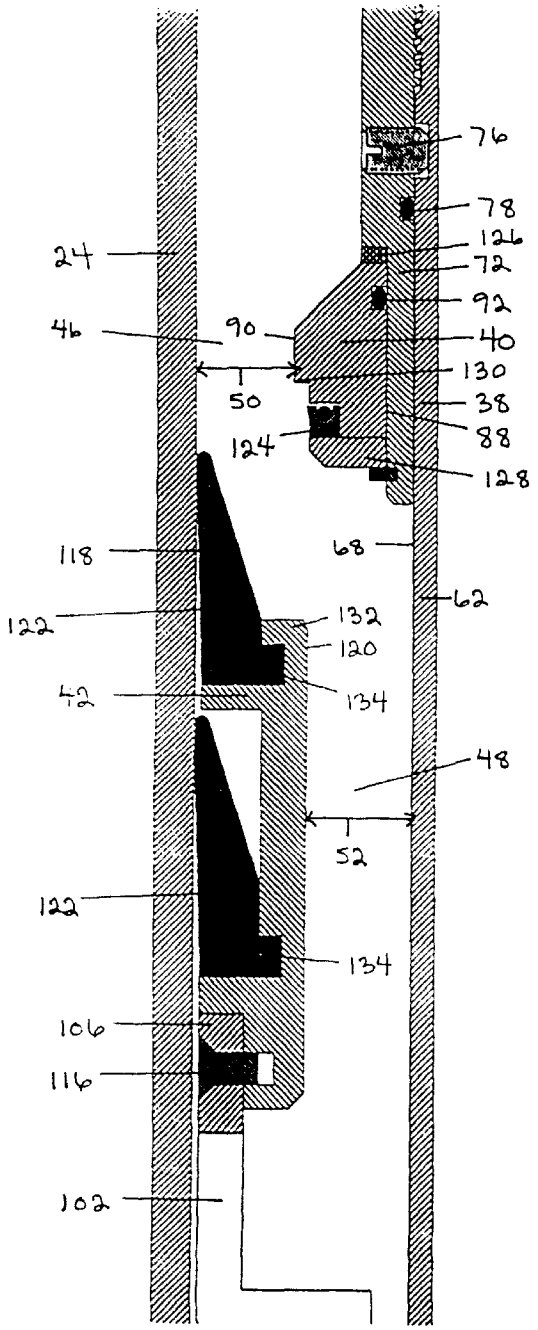
FIGS. 16(*a*) and 16(*b*) are detailed longitudinal sectional views of the lower packer valve shown in FIG. 11(*b*), wherein FIG. 16(*b*) is a lower continuation of FIG. 16(*a*)
Figure 16B:
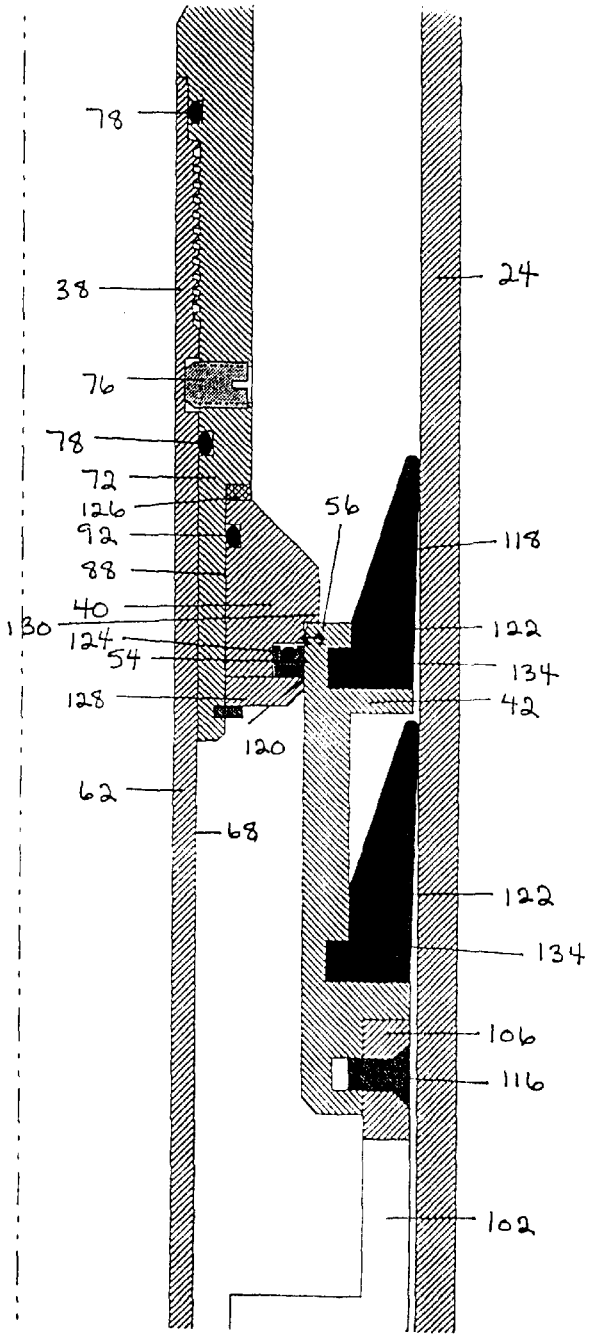
Figure 17A:
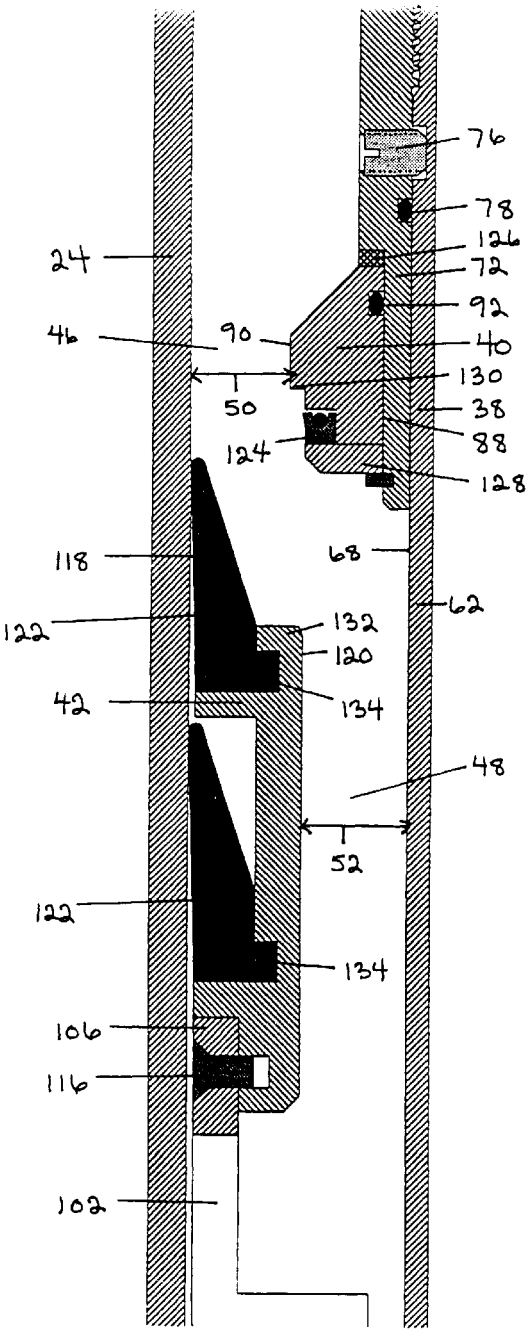
FIGS. 17(*a*) and 17(*b*) are detailed longitudinal sectional views of an inner packing member and an outer packing member comprising the lower packer valve shown in FIG. 16(*a*), shown in the open flow position and closed flow position respectively.
Figure 17B:
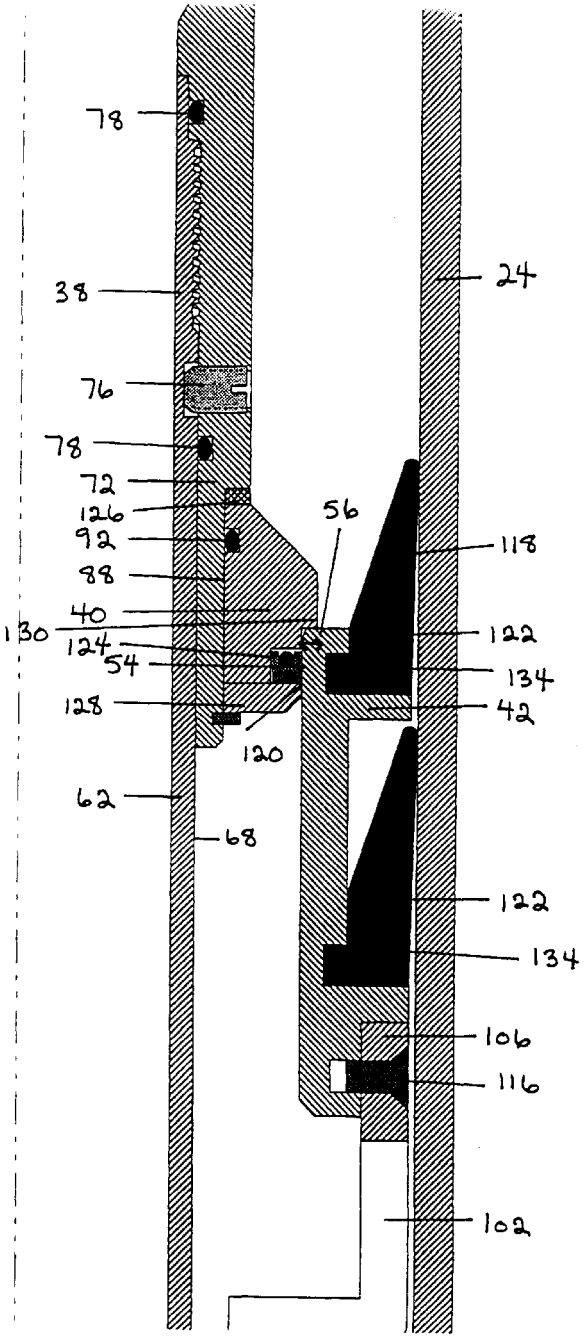

Further, the embodiment of the apparatus (20) shown in FIGS. 11 through 17 is preferably used for a straddle application isolating an intermediate zone of the formation. In this embodiment, the apparatus (20) is preferably comprised of two packer valves (28) connected together in series with a tubing valve (30). Specifically, the tubing valve (30) is located between an upper packer valve (32) and a lower packer valve (34). In addition, the specific configuration of the packer valves (32, 34) for this application may vary, as discussed further below. However, the packer valves (32, 34) are preferably "cup-type valves" as shown in FIGS. 13(*a*) and (*b*) and FIGS. 17(*a*) and (*b*). The cup-type valve may be preferred as it provides a seal upon the application of fluid pressure to it. As a result, the cup-type valve may assist in the setting or actuation of both packer valves (32, 34). The upper packer valve (32) and the tubing valve (30) may also be used in combination for steaming a lower zone of the formation. With this configuration, the lower zone could be steamed down the tubing string (22) without having to unseat the downhole pump.

Referring to the first application as shown in FIGS. 2(*a*) and (*b*), the packer valve (28) is actuatable between a closed flow position, as shown in FIG. 2(*a*), and an open flow position, shown in FIG. 2(*b*). To steam the upper zone of the formation, the packer valve (28) is positioned within the wellbore (24) at a location below the desired zone to be steamed. The packer valve (28) is then actuated to the closed position and steam is injected into the wellbore annulus (26) above the packer valve (28). The presence of the packer valve (28) restricts the flow of the steam past the packer valve (28) and causes the steam to be directed from the wellbore annulus (26) into the surrounding formation through the wall of the wellbore (24).

Once. steaming is completed, the packer valve (28) is actuated to the open flow position for the production of the wellbore (24). As a result, production fluids from the upper zone of the formation are permitted to enter the wellbore annulus (26) and flow downhole through the wellbore annulus (26) past the packer valve (28) to a downhole pump. As well, any gas from the zones located below the packer valve (28) would be permitted to flow up the wellbore annulus (26) uphole for venting or collection at the surface.

Referring to the second application as shown in FIGS. 11(*a*) and (*b*), the upper and lower packer valves (32, 34) are each actuatable between a closed flow position, shown in FIG. 11(*a*), and an open flow position, shown in FIG. 11(*b*). The tubing valve (30) is also actuatable between a closed position and an open position. In particular, actuation of the packer valves (28) to a closed flow position moves the tubing valve (30) to the open position, while actuation of the packer valves (28) to the open flow position moves the tubing valve (30) to the closed position.

To steam a desired intermediate zone of the formation, the packer valves (28) are positioned within the wellbore (24) such that the desired zone to be steamed is located therebetween. In other words, the desired zone is intermediate the two packer valves (32, 34). The packer valves (32, 34) are then both actuated to the closed flow position and the tubing valve (30) is actuated to the open position. Steam is then injected through the tubing string (22) with the downhole pump seated and is permitted to pass into the wellbore annulus (26) at the location of the open tubing valve (30) between the upper and lower packer valves (32, 34). The presence of the packer valves (32, 34) restricts the flow of the steam either uphole past the upper packer valve (32) or downhole past the lower packer valve (34) and causes the steam to be directed from the wellbore annulus (26) into the surrounding formation through the wall of the wellbore (24).

Once steaming is completed, the packer valves (32, 34) are actuated to the open flow position and the tubing valve (30) is closed for the production of the wellbore (24). As a result, production fluids from any zone of the formation are permitted to enter the wellbore annulus (26) and flow downhole through the wellbore annulus (26) past the packer valves (32, 34) to a downhole pump. As well, any gas from any of the zones is permitted to flow up the wellbore annulus (26) for venting or collection at the surface.

To steam a desired lower zone of the formation, the packer valve (28) may be used in combination with the tubing valve (30). The packer valve (28) is positioned within the wellbore (24) at a location above the desired zone to be steamed. The tubing valve (30) is located below or downhole of the packer valve (28). The packer valve (28) is then actuated to the closed flow position and the tubing valve (30) is actuated to the open position. Steam is then injected through the tubing string (22) with the downhole pump seated and is permitted to pass into the wellbore annulus (26) at the location of the open tubing valve (30) below the packer valve (28). The presence of the packer valve (28) restricts the flow of the steam uphole past the packer valve (28) and causes the steam to be directed from the wellbore annulus (26) into the surrounding formation through the wall of the wellbore (24).

Once steaming is completed, the packer valve (28) is actuated to the open flow position and the tubing valve (30) is closed for the production of the wellbore (24). As a result, production fluids from any zone of the formation are permitted to enter the wellbore annulus (26) and flow downhole through the wellbore annulus (26) past the packer valve (28) to a downhole pump. As well, any gas from any of the zones is permitted to flow up the wellbore annulus (26) uphole for venting or collection at the surface.

The packer valve (28) of the apparatus (20) may be comprised of any type or configuration of valve or valving device or mechanism capable of actuation between a closed flow position, regulating or restricting the flow of fluid through the wellbore annulus (26), and an open flow position, permitting the flow of fluid therethrough, and connectable to the tubing string (22). Specifically, the packer valve (28) is preferably connectable to the tubing string (22) in a manner such that the packer valve (28) is manipulable, and may be actuated by, the manipulation of the connected tubing string (28).

The packer valve (28) may be of the type actuatable by the application of a longitudinal movement, rotary movement or combination thereof to the packer valve (28) through the manipulation of the tubing string (22). For instance, the tubing string (22) may be longitudinally or axially moved within the wellbore (24) either in isolation or in combination with a rotary movement or rotation of the tubing string (22) within the wellbore (24). However, preferably, the packer valve (28) is actuated through rotation of the tubing string (22).

The tubing string (22) may be rotated within the wellbore (24) by any method, mechanism, structure or device capable of rotating the tubing string (22) within the wellbore (24) to actuate the packer valve (28), including manual rotation of the tubing string (22). In any case, the tubing string (22) is preferably rotated within the wellbore (24) at the surface. In the preferred embodiment, the tubing string (22) is preferably rotated by a tubing rotator (36). Thus, the packer valve (28) is actuated through rotation of the tubing string (22) by the tubing rotator (36).

Where a tubing rotator (36) is utilized, the rotation of the tubing string (22) by the tubing rotator (36) actuates the packer valve (28) between the closed flow position and the open flow position. The packer valve (28) may be actuated between the open and closed flow positions through rotation of the tubing string (22) in a single direction. However, preferably, rotation of the tubing string (28) in a first direction actuates the packer valve (28) to the closed flow position, while rotation of the tubing string (22) in a second opposed direction actuates the packer valve (28) to the open flow position.

In the preferred embodiment, the components of the tubing string (22) are connected by a threaded connection and the tubing string (22) is connected with the packer valve (28) by a further threaded connection. A right or clockwise rotation of the tubing string (22), when viewed from above, tends to tighten these threaded connections. In the preferred embodiment of the apparatus (20), the first direction of rotation of the tubing string (22), to actuate the packer valve (28) to the closed flow position, is a left or counterclockwise rotation of the tubing string (22) when viewed from above. The second direction of rotation of the tubing string (22), to actuate the packer valve (28) to the open flow position, is a right or clockwise rotation of the tubing string (22) when viewed from above.

As a result, it is possible for additional rotational force to be applied through the tubing string (22) to the packer valve (28) to unset the packer valve (28) or move the packer valve (28) to the open flow position without accidentally unscrewing the threaded connections as discussed above. In addition, it is possible to rotate the tubing string (22) part of a turn to the right periodically when the well is in production, and the packer valve (28) is open, in order to reduce tubing wear and steam jetting of the tubing string (22). Conversely, the amount or number of turns of left rotation required to close the packer valve (28) are not sufficient to unthread or unscrew the threaded connections of the tubing string (22).

In the closed flow position, the packer valve (28) substantially seals the wellbore annulus (26) to restrict the flow of fluid therethrough. In the open flow position, the flow of fluid is permitted through the wellbore annulus (26). Preferably, when in the open flow position, the packer valve (28) maximizes the flow of fluid permitted past or across the packer valve (28). In particular, when in the open flow position, the packer valve (28) defines a flow passage which permits the fluid to flow relatively unrestricted or unimpeded between the wellbore annulus (26) above the packer valve (28) and the wellbore annulus (26) below the packer valve (28). To minimize as much as possible any restrictions or impediments to the flow of the fluid through the flow passage, the flow area of the flow passage is maximized.

As stated, the tubing rotator (36) may be comprised of any device, mechanism or structure capable of rotating the tubing string (22) within the wellbore (24). However, preferably, the tubing rotator (36) is capable of rotating the tubing string (22), or is capable of permitting the tubing string (22) to be rotated, in both the first and second directions. Tubing rotators (36) are typically used in the industry to suspend and rotate the tubing string (22) within the wellbore (24) and therefore, they often form a part of the wellhead typically found at the surface.

By rotating the tubing string (22), typical wear occurring within the internal surface of the tubing string (22) by a reciprocating or rotating rod string is distributed over the entire internal surface of the tubing string (22). As a result, the tubing rotator (36) is often provided to prolong the life of the tubing string (22). Further, the constant movement of the tubing string (22) relative to the rod string may inhibit or reduce the buildup of wax and other materials within the tubing string (22).

Referring to FIG. 1, the tubing rotator (36) is preferably connected to or mounted with the other components of the wellhead or other wellhead equipment by any fastening or connecting means, mechanism, structure or device suitable for fastening or connecting the tubing rotator (36) to such other wellhead equipment. Specifically, any means, structure, device or mechanism suitable for mounting the tubing rotator (36) to the particular wellhead structure may be used as long as it is compatible with the function and purpose of the tubing rotator (36). Further, a lower end of the tubing rotator (36) is connectable to the tubing string (22) by any fastening or connecting means, mechanism, structure or device suitable for fastening or connecting the tubing rotator (36) to the tubing string (22).

In the preferred embodiment, the tubing rotator (36) is comprised of a swivel tubing hanger and a drive gear or other drive mechanism or structure for driving or rotating the swivel tubing hanger. Any swivel tubing hanger compatible with its use as described herein may be used. The swivel tubing hanger is for connecting to the tubing string (22) such that the tubing string (22) is rotatably suspended thereby within the wellbore (24). Further, the tubing hanger includes a driven gear or other structure or mechanism which is compatible with the drive gear or drive structure or mechanism. Thus, the driven gear, structure or mechanism and the drive gear, structure or mechanism comprise the drive system of the tubing rotator (36) which causes the tubing string (22) connected to the tubing hanger to be rotated within the wellbore (24). In particular, in the preferred embodiment, actuation of the drive gear acts on the driven gear of the tubing hanger in order to rotate the tubing hanger with the attached tubing string (22).

In the preferred embodiment, the tubing hanger is further comprised of a supporting member and a supported member or mandrel rotatably supported within the supporting member. The supporting member may be comprised of any members, elements, structure, device, apparatus or mechanism suitable for rotatably supporting the supported member such that the tubing string (22) connected to the supported member may be rotatably supported within the wellbore (24). As well, the supporting member may rotatably support the supported member in any manner or by any means or mechanism suitable for performing this intended function.

Further, in the preferred embodiment, the supporting member is tubular to rotatably support the supported member therein. As well, the supported member is tubular such that a bore of the supported member permits the passage of the rod string and wellbore fluids therethrough. Preferably, the supported member is rotatably supported within the supporting member by at least one bearing located between the supported member and the supporting member such that the bearing is seated on the supporting member and the supported member is rotatably supported upon the bearing. Any bearing suitable for, and compatible with, this intended purpose or function may be used.

Further, the supported member is associated with the driven gear such that rotation of the driven gear causes the supported member to rotate within the supporting member. Any structure, device, mechanism or means for associating the supported member and the driven gear in the described manner may be used. However, preferably, the driven gear is fixedly mounted or connected about the supported member for engagement with the drive gear. The driven gear may be mounted or otherwise fastened to the supported member by any suitable means, structure, device or mechanism for mounting or fastening the driven gear thereto.

As stated, the drive system of the tubing rotator (36) is comprised of any drive gear, structure or mechanism and any driven gear, structure or mechanism. In the preferred embodiment, the drive system is comprised of the drive gear and the driven gear. The drive gear and the driven gear may be comprised of any gears capable of performing the functions or purposes set herein, and which permit the drive gear and the driven gear to engage each other. For instance, the drive gear may be comprised of a worm and the driven gear may be comprised of a worm gear. Alternately, the drive gear may be comprised of a pinion and the driven gear may be comprised of a crown gear or the drive gear may be comprised of a male spline and the driven gear may be comprised of a female spline.

Finally, the tubing rotator (36) may normally rotate the tubing string (22) in either a right or clockwise direction, when viewed from the top, or in a left or counterclockwise direction. However, in the preferred embodiment, the tubing rotator (36) normally rotates to the right or clockwise. Further, as indicated, in the preferred embodiment, the first direction of rotation of the tubing string (22), to actuate the packer valve (28) to the closed flow position, is a left or counterclockwise rotation of the tubing string (22), when viewed from above. The second direction of rotation of the tubing string (22), to actuate the packer valve (28) to the open flow position, is a right or clockwise rotation of the tubing string (22), when viewed from above. Accordingly, the normal rotation of the tubing string (36) to the right will tend to maintain the packer valve (28) in the open flow position.

Referring to FIGS. 2 through 17, the packer valve (28) is preferably comprised of a packer body (38), an inner packing member (40) and an outer packing member (42). The packer body (38) is provided for connection with the tubing string (22) such that the packer body (38) is manipulable through manipulation of the tubing string (22). The packer body (38) has a longitudinal bore (44) extending therethrough for communication with the tubing string (22). As a result, fluid may be continuously conducted through the tubing string (22) and the packer body (38).

The inner packing member (40) is associated with the packer body (38) in a manner such that the inner packing member (40) extends radially outwardly from the packer body (38), or away from the longitudinal bore (44). The inner packing member (40) may be associated with the packer body (38) by any means, mechanism, structure or device suitable for and capable of fastening, connecting, mounting or otherwise relating the inner packing member (40) with the packer body (38). Further, an outer annular space (46) is defined between the inner packing member (40) and the wellbore (24) when the packer valve (28) is positioned within the wellbore (24).

The outer packing member (42) is also associated with the packer body (38) in a manner such that the outer packing member (42) is movable axially relative to the inner packing member (40). The outer packing member (42) may be associated with the packer body (38) by any means, mechanism, structure or device suitable for and capable of fastening, connecting, mounting or otherwise relating the outer packing member (42) with the packer body (38). Further, the outer packing member (42) is a spaced radial distance from the packer body (38) to define an inner annular space (48) therebetween for bypassing the outer packing member (42).

The outer annular space (46) and the inner annular space (48) comprise the flow passage in the open flow position. Specifically, in the open flow position, the inner and outer annular spaces (48, 46) communicate with each other so that fluid may pass therebetween. Thus, fluid above the packer valve (28) may enter the outer annular space (46), pass into the inner annular space (48), and exit the inner annular space (48) to a position below the packer valve (28). Conversely, fluid below the packer valve (28) may enter the inner annular space (48), pass into the outer annular space (46), and exit the outer annular space (46) to a position above the packer valve (28). When the packer valve (28) is actuated to the closed flow position, the flow passage is interrupted and communication between the inner and outer annular spaces (48, 46) is restricted.

The outer annular space (46) has a radial dimension (50) and the inner annular space (48) has a radial dimension (52). Each of these radial dimensions (50, 52) may be any amount permitting the fluid to flow therethrough in the open flow position. However, preferably, each of these radial dimensions (50, 52) is maximized to maximize the flow area through the inner and outer annular spaces (48, 46) and thus, minimize any interference with the flow of fluid through the wellbore annulus (26) due to the presence of the packer valve (28) therein. As shown in the figures, the outer annular space (46) and the inner annular space (48) thus each define a flow path which is substantially unobstructed, i.e., no other components of the packer valve substantially restrict flow through these flow paths when the packer valve is in the open flow position. Preferably all the fluid flow, and certainly a majority of fluid flow, is thus passed through the substantially unobstructed flow paths formed by the outer annular space (46) and the inner annular space (48) when the packer valve is in the open flow position. In order to maximize the flow and pass the largest particles possible through the inner and outer annular spaces (48,46), the radial dimension (50) of the outer annular space (46) is preferably about equal to the radial dimension (52) of the inner annular space (48) in the open flow position.

For example, in the preferred embodiment of the apparatus (20), wherein the packer valve (28) is fabricated for 7 inch wellbore casing (24) and 2⅞ inches tubing string (22), the outer annular space (46) has a radial dimension (50) of about 0.81 inches and the inner annular space (48) has a radial dimension (52) of about 0.85 inches. Where the dimensions of the casing and the tubing string (22) are either greater or less than the preferred embodiment, the radial dimensions (50, 52) will be increased or reduced proportionately.

The inner packing member (40) is movable axially relative to the outer packing member (42) to actuate the packer valve (28) between the closed flow and open flow positions. Specifically, the packer valve (28) is actuated to the closed flow position by moving the inner packing member (40) axially relative to the outer packing member (42) towards the outer packing member (42). In the closed flow position, the outer packing member (42) is engaged with the inner packing member (40) and the wellbore (24), or is engaged between the inner packing member (40) and the wellbore (24), to substantially seal the outer annular space (46) and the inner annular space (48).

Further, in the closed flow position, when the inner and outer packing members (40, 42) are sealingly engaged, the inner packing member (40) and the outer packing member (42) define a location of contact (54) where the packing members (40, 42) abut or engage each other. Depending upon the specific configuration of the particular packer valve (28) and its inner and outer packing members (40, 42), the inner and outer packing members (40, 42) may overlap as seen for example, in FIG. 10(*b*), to provide the location of contact (54). In other words, the outermost edge of the inner packing member (40) extends radially outward beyond the innermost edge of the outer packing member (42). In this case, the location of contact (54) has a radial dimension (56). Preferably, in order to assist in maximizing the radial dimensions (50, 52) of the outer and inner annular spaces (46, 48), the radial dimension (56) of the location of contact (54) is minimized while still permitting the sealing engagement therebetween.

The packer valve (28) is actuated to the open flow position by moving the inner packing member (40) axially relative to the outer packing member (42) away from the outer packing member (42). In the open flow position, the outer packing member (42) is disengaged from at least the inner packing member (40), and may be disengaged from both the inner packing member (40) and the wellbore (24). As a result, the outer annular space (46) communicates with the inner annular space (48) to permit the flow of fluid through the outer annular space (46) and inner annular space (48).

As discussed previously, any movement of the tubing string (22) may actuate the packer valve (28) between the open and closed flow positions. More particularly, any movement or manipulation of the tubing string (22) may result in the axial movement of the inner packing member (40) relative to the outer packing member (42). However, preferably, rotation of the tubing string (22) in the first and second directions actuates the packer valve (28). In the preferred embodiment, rotation of the tubing string (22) in the first direction causes the inner packing member (40) to move axially relative to the outer packing member (42) towards the closed flow position. Rotation of the tubing string (22) in the second direction causes the inner packing member (40) to move axially relative to the outer packing member (42) towards the open flow position.

Relative axial movement of the inner and outer packing members (40, 42) may be achieved upon the rotation of the tubing string (22) in any manner and using any mechanism, structure or device capable of converting, translating or relating the rotational movement to the relative axial movement. However, preferably, rotation of the tubing string (22) rotates the inner packing member (40) relative to the outer packing member (42). Further, the rotation of the inner packing member (40) relative to the outer packing member (42) is preferably translated into axial movement of the inner packing member (40) relative to the outer packing member (42). The rotational movement may be translated into the axial movement using any mechanism, device or structure capable of translating the relative movements as required. Preferably, as described in detail below, the translation mechanism comprises a threaded connection between the inner packing member (40) and the outer packing member (42).

In order to assist or aid in the relative rotational movement of the inner and outer packing members (40, 42), the apparatus (20) preferably further comprises a drag member (58). The drag member (58) is associated with the outer packing member (42) for engaging the wellbore (24) to inhibit rotation of the outer packing member (42) within the wellbore (24) upon rotation of the inner packing member (40). The drag member (58) may be associated with the outer packing member (42) by any means, mechanism, structure or device suitable for and capable of fastening, connecting, mounting or otherwise relating the drag member (58) with the outer packing member (42). In addition, the drag member (58) may be a separate unit or element from the outer packing member (42) or it may be integrally formed with the outer packing member (42) to form a single unit or unitary member.

The drag member (58) may be comprised of any device, mechanism or structure able to inhibit the rotation of the outer packing member (42) within the wellbore (24) and the drag member (58) may inhibit the rotation in any manner. For instance, the drag member (58) may be comprised of one or more bow springs associated with the outer packing member (42) for engaging the wellbore (24). In the preferred embodiment, the drag member (58) is comprised of one or more drag blocks (60) associated with the outer packing member (42) for engaging the wellbore (24), as described in detail below.

Referring to FIGS. 3–5, 12 and 16, in the preferred embodiment, the packer body (38) is comprised of a tubular packer mandrel (62) having an upper end (64), a lower end (66), an outer surface (68) and a longitudinal bore (70). The longitudinal bore (70) extends between the upper and lower ends (64, 66) and permits continuous fluid communication with the tubing string (22) both above and below the packer valve (28).

The upper end (64) of the packer mandrel (62) is connectable to the tubing string (22) in any manner and by any structure, device or mechanism permitting the packer mandrel (62) to rotate upon rotation of the tubing string (22). In the preferred embodiment, the upper end (64) of the packer mandrel (62) is comprised of a tubular top coupling (72). The top coupling (72) is threadably connected with the packer mandrel (62) to form the upper end (64) of the packer mandrel (62). However, the top coupling (72) may be integrally formed with the remainder of the packer mandrel (62). In the preferred embodiment, this threaded connection is secured by at least one, and preferably eight, set screws (76). As well, this threaded connection is preferably sealed, such as by one or more O-rings (78). Finally, this threaded connection is preferably a stub Acme right-hand, untapered threaded connection.

In any event, the top coupling (72) provides a mechanism or structure for attaching the packer mandrel (62) to, or connecting or affixing the packer mandrel (62) with, the tubing string (22). Preferably, the top coupling (72) provides a threaded connection (74) for connection with the tubing string (22). Although the threaded connection (74) may provide either right or left hand threads, the threaded connection (74) is preferably right-hand in that a right or clockwise rotation of the tubing string (22), when viewed from above, tends to tighten this threaded connection (74).

The lower end (66) of the packer mandrel (62) is similarly connectable to the tubing string (22) where it is desirable that the tubing string (22) extend further downhole below the packer valve (28). Alternately, the lower end (66) may be connected with other components of the apparatus (20) or additional packer valves (28) as discussed further below. In any case, the lower end (66) is connectable in any manner and by any structure, device or mechanism permitting the packer mandrel (62) to rotate.

In the preferred embodiment, the lower end (66) of the packer mandrel (62) is comprised of a tubular bottom coupling (80) and a clutch ring (81). The bottom coupling (80) is threadably connected with the packer mandrel (62) to form the lower end (66) of the packer mandrel (62). However, the bottom coupling (80) may be integrally formed with the remainder of the packer mandrel (62). The clutch ring (81) is preferably secured to the bottom coupling (80) by at least one, and preferably four, set screws (82). In addition, the threaded connection between the bottom coupling (80) and the packer mandrel (62) may be secured by one Or more, and preferably four, set screws (83) as shown in FIG. 12(*b*). As well, this threaded connection is preferably sealed, such as by one or more O-rings (84). Finally, this threaded connection is preferably a stub Acme right-hand, untapered threaded connection.

In any event, the bottom coupling (80) provides a mechanism or structure for attaching the packer mandrel (62) to, or connecting or affixing the packer mandrel (62) with, the tubing string (22) or other components of the apparatus (20). Preferably, the bottom coupling (80) provides a threaded connection (86) for connection with the tubing string (22). Although the threaded connection (86) may provide either right or left hand threads, the threaded connection (86) is preferably right-hand in that a right or clockwise rotation of the tubing string (22), when viewed from above, tends to tighten this threaded connection (86).

In the preferred embodiment, the inner packing member (40) is mounted about the packer mandrel (62) such that the inner packing member (40) extends radially outwardly from the outer surface (68) of the packer mandrel (62). The inner packing member (40) may be located anywhere along the length of the packer mandrel (62), however, preferably the inner packing member (40) is located adjacent to or in proximity to the upper end (64) of the packer mandrel (62). In the preferred embodiment, the inner packing member (40) is mounted about a lower end of the top coupling (72) comprising the upper end (64) of the packer mandrel (62).

The inner packing member (40) has an inner surface (88) and an outer surface (90). The inner surface (88) engages the outer surface (68) of the packer mandrel (62), preferably sealing therewith. As a result, one or more seals (92), preferably O-rings, are preferably located between the inner surface (88) of the inner packing member (40) and the outer surface (68) of the packer mandrel (62). The outer surface

(90) of the inner packing member (40) extends outwardly from the packer mandrel (62) for engagement with the outer packing member (42).

The inner packing member (40) may be mounted about the packer mandrel (62) in any manner and by any structure, device or mechanism capable of mounting the inner packing member (40) about the packer mandrel (62). For instance, the inner packing member (40) may be rotatably or fixedly mounted with the packer mandrel (62). In other words, the inner packing member (40) may be permitted to rotate relative to the packer mandrel (62). The specific mechanism and manner of mounting the inner packing member (40) will vary depending upon the specific configuration of the packer valve (28) and its inner and outer packing members (40, 42). In addition, the inner packing member (40) may have any shape or configuration permitting the inner packing member (40) to sealingly engage the outer packing member (42) in the closed flow position. However, again, the specific shape and configuration of the inner packing member (40) will vary depending upon the overall configuration of the packer valve (28) and the outer packing member (42).

The packer valve (28) is further comprised of a packer sleeve (94) mounted about the packer mandrel (62) such that rotation of the packer mandrel (62) relative to the packer sleeve (94) is translated into axial movement of the packer mandrel (62) relative to the packer sleeve (94). The packer sleeve (94) may be located anywhere along the length of the packer mandrel (62) adjacent the inner packing member (40). Further, the packer sleeve (94) may be mounted about the packer mandrel (62) either above or below the inner packing member (40).

In other words, the packer sleeve (94) may be mounted about the packer mandrel (62) between the upper end (64) of the packer mandrel (62) and the inner packing member (40). In this case, the packer mandrel (62) would move axially upwardly relative to the packer sleeve (94) to actuate the packer valve (28) to the closed flow position. However, preferably, the packer sleeve (94) is mounted about the packer mandrel (62) between the lower end (66) of the packer mandrel (62) and the inner packing member (40). As a result, the packer mandrel (62) moves axially downwardly relative to the packer sleeve (94) to actuate the packer valve (28) to the closed flow position.

The packer sleeve (94) may be mounted about the packer mandrel (62) in any manner and by any structure, device or mechanism capable of mounting the packer sleeve (94) about the packer mandrel (62) and translating rotational movement into axial movement. In the preferred embodiment, movement is translated by a threaded connection between the packer mandrel (62) and the packer sleeve (94). In particular, the packer sleeve (94) has an inner surface (96) comprising an inner threaded portion (98). The outer surface (68) of the packer mandrel (62) comprises an outer threaded portion (100). The outer threaded portion (100) of the packer mandrel (62) is engaged with the inner threaded portion (98) of the packer sleeve (94) so that rotation of the packer mandrel (62) relative to the packer sleeve (94) is translated into axial movement of the packer mandrel (62) relative to the packer sleeve (94). Further, the inner threaded portion (98) preferably sealingly engages the outer threaded portion (100). The sealing may be accomplished by any sealing mechanism or structure, such as one or more O-rings (101). In this case, the O-ring (101) slides to permit relative axial movement and rotation between the threaded surfaces (98, 100).

The inner threaded portion (98) and the outer threaded portion (100) may be comprised of any compatible threads able to provide the necessary threaded connection between the packer mandrel (62) and the packer sleeve (94). However, preferably, in order to minimize the amount of space required to accommodate the threaded connection, the threads are stub Acme threads, having an untapered square profile. In addition to having less space requirements, Acme threads are not wedged together upon tightening. Rather, rotation and axial movement are permitted between the inner and outer threaded portions (98, 100) until the ends of the threads are reached.

As well, the threaded connection between the inner and outer threaded portions (98, 100) may comprise either right or left hand threads. However, as discussed above, this threaded connection is preferably left-hand in that a left or counterclockwise rotation of the packer mandrel (62) relative to the packer sleeve (94) causes relative axial movement of the inner packing member (40) towards the outer packing member (42) and actuates the packer valve (28) to the closed flow position. Thus, in the preferred embodiment of the apparatus (20), the first direction of rotation of the tubing string (22), to actuate the packer valve (28) to the closed flow position, is a left or counterclockwise rotation of the tubing string (22), when viewed from above. The left or counterclockwise rotation of the tubing string (22) results in the left or counterclockwise rotation of the packer mandrel (62) relative to the packer sleeve (94).

Further, in the preferred embodiment, the outer packing member (42) is mounted with the packer sleeve (94) so that the inner packing member (40) is movable axially relative to the outer packing member (42) upon axial movement of the packer mandrel (62) relative to the packer sleeve (94). Thus, the outer packing member (42) is preferably mounted at an end of the packer sleeve (94) to assist its engagement with the inner packing member (40). However, the outer packing member (42) may be mounted anywhere along the packer sleeve (94) permitting the necessary engagement.

The outer packing member (42) may be mounted with the packer sleeve (94) in any manner and by any structure, device or mechanism capable of mounting the outer packing member (42) with the packer sleeve (94). For instance, the outer packing member (42) may be rotatably or fixedly mounted with the packer sleeve (94). The specific mechanism and manner of mounting the outer packing member (42) will vary depending upon the specific configuration of the packer valve (28) and its inner and outer packing members (40, 42). In addition, the outer packing member (42) may have any shape or configuration permitting the outer packing member (42) to sealingly engage the inner packing member (40) and the wellbore (24) in the closed flow position. However, again, the specific shape and configuration of the outer packing member (42) will vary depending upon the overall configuration of the packer valve (28) and the inner packing member (40).

In the preferred embodiment, the packer sleeve (94) is comprised of a valve cup (102) at one end thereof for mounting of the outer packing member (42) with the packer sleeve (94). The valve cup (102) has a lower end (104) which is connected or affixed, directly or indirectly, with the inner threaded portion (98) of the inner surface (96) of the packer sleeve (94). In the preferred embodiment, the lower end (104) of the valve cup (102) is affixed to a drag body (108), also comprising the packer sleeve (94), by one or more, preferably eight, set screws (110). The drag body (108) is affixed to the inner threaded portion (98) of the packer sleeve (94) by one or more, preferably ten, shear pin screws (112). However, any other fasteners or mechanism for fastening may be used in place of the set screws (110) and shear pin screws (112).

In the preferred embodiment of the apparatus (20) as discussed above, wherein the packer valve (28) is fabricated for 7 inch wellbore casing (24) and 2⅞ inches tubing string (22), the annular space between the lower end (104) of the valve cup (102) and the wellbore (24) has a radial dimension of about 1.18 inches. In any event, this annular space should be maximized to maximize the flow area past the apparatus (20).

The outer packing member (42) is mounted with the upper end (106) of the valve cup (102) in a manner such that the outer packing member (42) is a spaced radial distance from the outer surface (68) of the packer mandrel (62) to define the inner annular space (48) for bypassing the outer packing member (42). As well, referring to FIGS. 6 and 7, in order to provide the bypassing of the outer packing member (42), the valve cup (102) defines a plurality of valve passages (114) for the passage of fluid therethrough. In the preferred embodiment, the valve cup (102) defines four equidistantly spaced valve passages (114), the flow areas of which are maximized to minimize any interference with the passage of the fluid through the passages (114). Thus, the fluid flows downward through the inner annular space (48) and then passes through the valve passages (114) to exit to a location exterior of the packer sleeve (94). Conversely, the fluid flows upward through the valve passages (114) into the inner annular space (48).

The outer packing member (42) may be mounted with the upper end (106) of the valve cup (102) by one or more fasteners or by any other manner of fastening or affixing the outer packing member (42) with the valve cup (102). In the preferred embodiment, the outer packing member (42) is mounted by eight cap screws (116). Further, although the outer packing member (42) may have any shape or configuration able to sealingly engage the inner packing member (40) and the wellbore (24), the outer packing member (42) preferably comprises a first surface (118) for sealingly engaging the wellbore (24) and a second surface (120) for sealingly engaging the inner packing member (40) in the closed flow position.

In order to provide the sealing engagement, at least one sealing member (122) is preferably associated with the first surface (118) of the outer packing member (42) for sealingly engaging the wellbore (24). Further, at least one sealing member (124) is preferably associated with at least one of the second surface (120) of the outer packing member (42) and the inner packing member (40) for sealingly engaging the inner and outer packing members (40, 42). Each of the sealing members (122, 124) may be comprised of any seals or sealing devices able to provide the sealing engagement.

In addition, in order to enhance or facilitate the sealing engagement between the first surface (118) of the outer packing member (42) and the wellbore (24), the outer packing member (42) may be capable of a limited amount of radial movement outwards or towards the wellbore (24). Specifically, the engagement of the second surface (120) of the outer packing member (42) with the inner packing member (40) may cause the outer packing member (42) to move radially outwardly to sealingly engage the first surface (118) of the outer packing member (42) with the wellbore (24).

As discussed, the specific shape and configuration of each of the inner and outer packing members (40, 42) may vary depending upon a number of factors, including the shape and configuration of the other packing member (40, 42). Four possible configurations of the inner and outer packing members (40, 42) are shown in FIGS. 8(*a*) and (*b*), FIG. 9(*a*) and (*b*), FIGS. 10(*a*) and (*b*) and FIGS. 13(*a*) and (*b*) and 17(*a*) and (*b*).

Figure 9A:
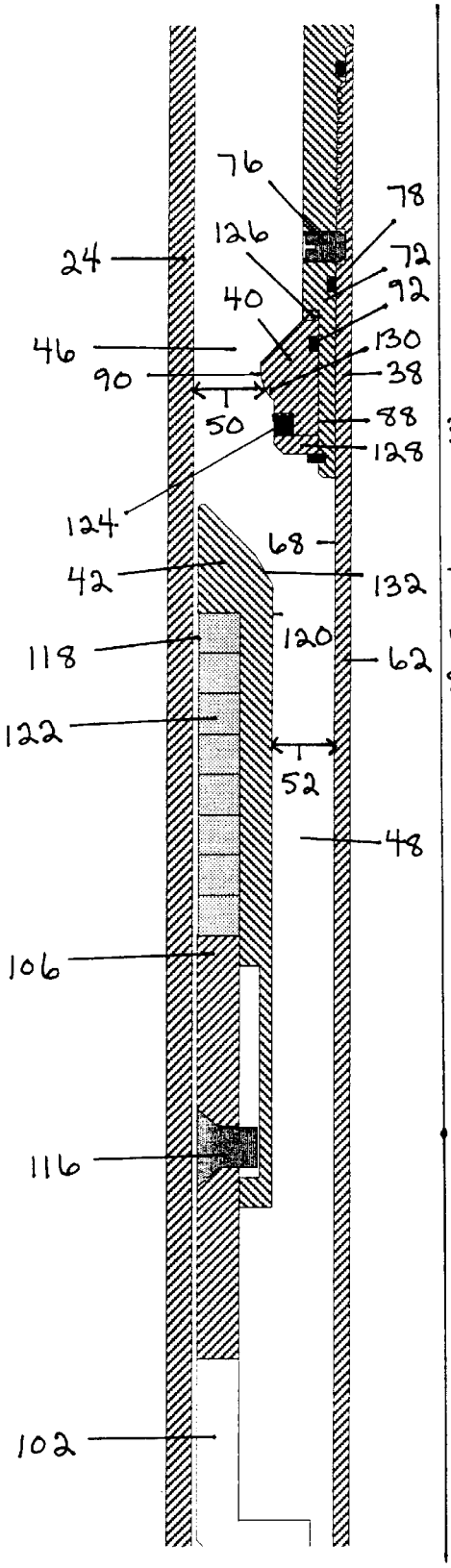
FIGS. 9(*a*) and 9(*b*) are detailed longitudinal sectional views of an alternate embodiment of the inner packing member and the outer packing member, shown in the open flow position and closed flow position respectively.
Figure 9B:
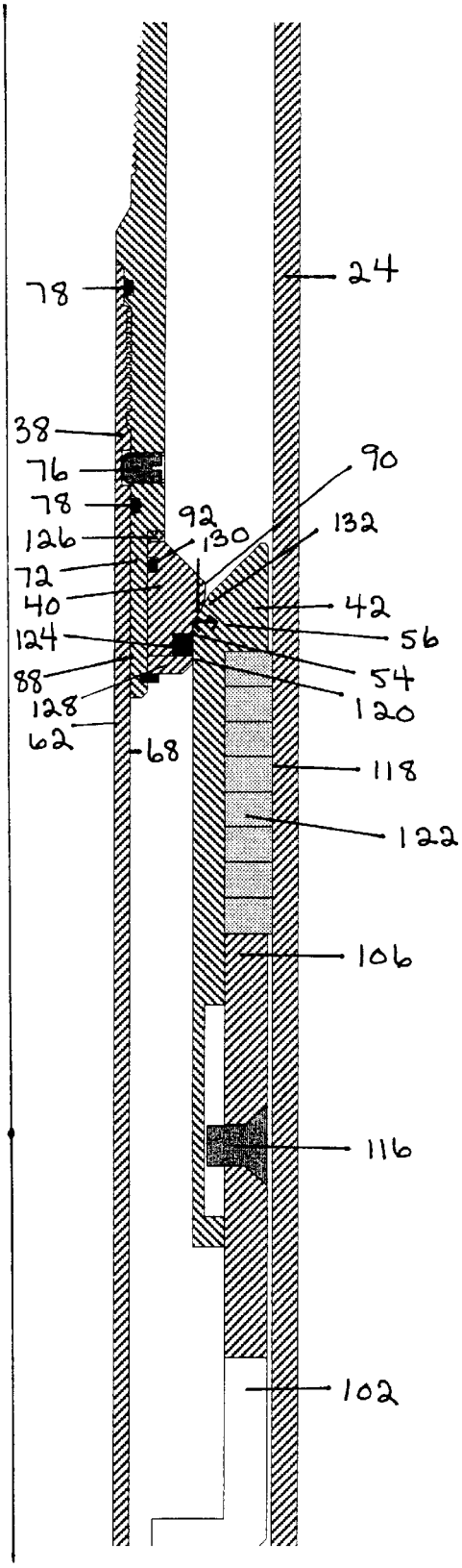

The embodiments shown in FIGS. 8(*a*) and (*b*), FIG. 9(*a*) and (*b*) and FIG. 10(*a*) and (*b*) are preferably used when using the apparatus (20) for top zone steaming of the formation. Specifically, FIGS. 8(*a*) and (*b*) shows the preferred embodiment in this application, while FIGS. 9(*a*) and (*b*) and FIGS. 10(*a*) and (*b*) show two alternate embodiments. The embodiment shown in FIGS. 13(*a*) and (*b*) and 17(*a*) and (*b*) is preferably used when using the apparatus (20) for the straddle application for steaming an intermediate zone of the formation. For the straddle application, FIGS. 13(*a*) and (*b*) shows the preferred embodiment of the upper packer valve (32), while FIGS. 17(*a*) and (*b*) shows the preferred embodiment of the lower packer valve (34).

FIGS. 8(*a*) and (*b*) show the preferred embodiment of the inner and outer packing members (40, 42) for use in top zone steaming. This embodiment is often referred to as a "packer-type valve." The inner packing member (40) is mounted with the packer mandrel (62) by, and retained in position between, a bushing (126) and a polypak retainer and spirolox ring (128). The outer surface (90) of the inner packing member (40) includes the sealing member (124) for sealing with the second surface (120) of the outer packing member (42). The sealing member (124) is comprised of a polypak seal. Further, the outer surface (90) defines a downwardly facing shoulder (130) for overlapping an upwardly facing shoulder (132) on the outer packing member (42) in the closed flow position. This shoulder (130) defines the radial dimension (56) of the location of contact (54) between the inner and outer packing members (40, 42).

In the preferred embodiment, the outer packing member (42) is preferably comprised of a packer slip ring, preferably comprised of steel, having an inner surface and an outer surface. The inner surface comprises the second surface (120) for engaging the inner packing member (40). The outer surface comprises the first surface (118) for engaging the wellbore (24). Further, the first surface (118) includes the sealing member (122). The sealing member (122) is comprised of an AFLAS® packer element retained within the outer surface of the packer slip ring. AFLAS® is a registered trade-mark of Asahi Glass Co., Ltd. of Japan and is comprised of a tetrafluoroethylene/propylene copolymer. Engagement of the inner and outer packing members (40, 42) may cause the AFLAS® packer element to bulge somewhat to facilitate or enhance the engagement with the wellbore (24). The AFLAS® packer element is preferred as the sealing member (122) due to its ability to withstand high temperatures typically experienced with steam injection, which may be as high as about 450° F. For this reason, any and all seals and O-rings which may be exposed to these high temperatures are preferably similarly comprised of AFLAS®.

FIGS. 9(*a*) and (*b*) show an alternate embodiment of the inner and outer packing members (40, 42) for use in top zone steaming. As in the previous embodiment, the inner packing member (40) is mounted with the packer mandrel (62) by, and retained in position between, a bushing (126) and a polypak retainer and spirolox ring (128). The outer surface (90) of the inner packing member (40) includes the sealing member (124) for sealing with the second surface (120) of the outer packing member (42). The sealing member (124) is comprised of a Teflon™ seal having an AGIS™ energizer ring. AGIS™ is also known by the brand name Kalrez™ and is believed to be comprised of a perfluoroelastomer. Further, the outer surface (90) defines a downwardly facing sloped shoulder (130) or sloped or inclined surface for overlapping an upwardly facing sloped shoulder (132) or sloped or inclined surface on the outer packing member (42) in the closed flow position. This shoulder (130) defines the radial dimension (56) of the location of contact (54) between the inner and outer packing members (40, 42). Further, the location of contact (54) between the downwardly facing sloped shoulder (130) of the inner packing member (40) and the upwardly facing sloped shoulder (132) of the outer packing member (42) preferably provides a metal to metal seal.

In this alternate embodiment, the outer packing member (42) is also preferably comprised of a packer slip ring, preferably comprised of steel, having an inner surface and an outer surface. The inner surface comprises the second surface (120) for engaging the inner packing member (40) to provide the metal to metal seal therebetween. The outer surface comprises the first surface (118) for engaging the wellbore (24). Further, the first surface (118) includes the sealing member (122). The sealing member (122) is preferably comprised of a thermal packing element or thermal packer, able to resist or endure higher temperatures, which is retained within the outer surface of the packer slip ring. However, in this alternate embodiment, the thermal packer is preferably comprised of graphite packing, which has been found to be able to withstand the higher temperatures typically experienced with steam injection.

FIGS. 10(*a*) and (*b*) show a further alternate embodiment of the inner and outer packing members (40, 42) for use in top zone steaming. This further alternate embodiment is often referred to as a "wedged cup-type valve." As in the previous two embodiments, the inner packing member (40) is mounted with the packer mandrel (62) by, and retained in position between, a bushing (126) and a spirolox ring (128). However, the outer surface (90) of the inner packing member (40) does not include the sealing member (124) for sealing with the second surface (120) of the outer packing member (42). Rather, the sealing member (124) is comprised of the portion of the outer packing member (42) contacting the inner packing member (40 at the location of contact (54), as discussed below. Further, the outer surface (90) of the inner packing member (40) provides the downwardly facing shoulder (130) for overlapping the upwardly facing shoulder (132) on the outer packing member (42) in the closed flow position. The location of contact (54) between the shoulders (130, 132) defines the radial dimension (56) of the location of contact (54) between the inner and outer packing members (40, 42).

In this further alternate embodiment, the outer packing member (42) is preferably comprised of an elastomer packing element, having an inner surface and an outer surface. The inner surface comprises the second surface (120) for engaging the inner packing member (40). The outer surface comprises the first surface (118) for engaging the wellbore (24). Given that the packing element is comprised of an elastomer material, the first surface (118) comprise the sealing member (122) between the outer packing member (42) and the wellbore (24). Similarly, the second surface (120) comprises the sealing member (124) between the inner and outer packing members (40, 42). In addition, the engagement of the inner and outer packing members (40, 42) may cause the elastomer packer element comprising the outer packing member (42) to move radially outwardly to facilitate or enhance the engagement with the wellbore (24).

FIGS. 13(*a*) and (*b*) and 17(*a*) and (*b*) show the preferred embodiment of the inner and outer packing members (40, 42) for the upper and lower packer valves (32, 34) for use in the straddle application for steaming an intermediate zone of the formation. Each of the upper and lower packer valves (32, 34) for this embodiment are often referred to as a "cup-type valves." The inner packing member (40) of each of the upper and lower packer valves (32, 34) is preferably identical to that described above for the preferred embodiment used for top zone steaming as shown in FIGS. 8(*a*) and (*b*).

In this embodiment, each outer packing member (42) has an inner surface and an outer surface. The inner surface comprises the second surface (120) for engaging the inner packing member (40). The outer surface comprises the first surface (118) for engaging the wellbore (24). More particularly, the outer surface or first surface (118) is comprised of at least one, and preferably two, elastomer cups (134) biased outwardly for engaging the wellbore (24). The cups (134) may be comprised of elastomer alone or may be reinforced with fabric or wire. Thus, the elastomer cup (134) comprises the sealing member (122) between the outer packing member (42) and the wellbore (24). The cups (134) are mounted so that the pressure of the fluid within the wellbore annulus (26) between the upper and lower packer valves (32, 34) during steam injection in the straddle application further urges the cups (134) radially outwardly to enhance or facilitate the sealing engagement therebetween. Thus, the cups (134) in the upper packer valve (32) are directed axially downwardly towards the lower packer valve (34), while the cups (134) in the lower packer valve (34) are directed axially upwardly towards the upper packer valve (32).

The cup type valve is preferred for the upper and lower packer valves (32, 34) as it permits the packer valves (32, 34) to more readily be rotated within the wellbore (24) when the fluid in the wellbore annulus (26) between the packer valves (32, 34) is not under pressure, such as during the setting of the apparatus (20) or actuation of the packer valves (32, 34) to the closed flow position. For instance, rotation of the tubing string (22) in the first direction may simultaneously actuate both the upper and lower packer valves (32, 34) to the closed position. However, simultaneous setting of the packer valves (32, 34) may be difficult. Thus, if one of the packer valves (32, 34) is actuated to the closed flow position prior to the other, the first closed packer valve slips or permits further rotation of the packer mandrel (62) in order to close the second packer valve. This slippage is more readily permitted using the cup type valve configuration of the upper and lower packer valves (32, 34).

As well, in order to accommodate elongation of the tubing string (22) due to thermal expansion, the apparatus (20) may be further comprised of an expansion tool (not shown), preferably mounted between the packer valve (28) and the tubing string (22). The expansion tool may be separate from the other components of the apparatus (20) or it may form an integral part of the other components. The expansion tool may not be necessary when using the cup type valve configuration of the packer valve (28) because the cups (134) permit the apparatus (20) to slip downhole as the tubing string (22) expands longitudinally.

In addition, for the straddle application, using the upper and lower packer valves (32, 34), the drag members (58) must also permit some slippage on rotation in the first direction to allow both the upper and lower packer valves (32, 34) to be set or actuated to the closed flow position.

Figure 3:
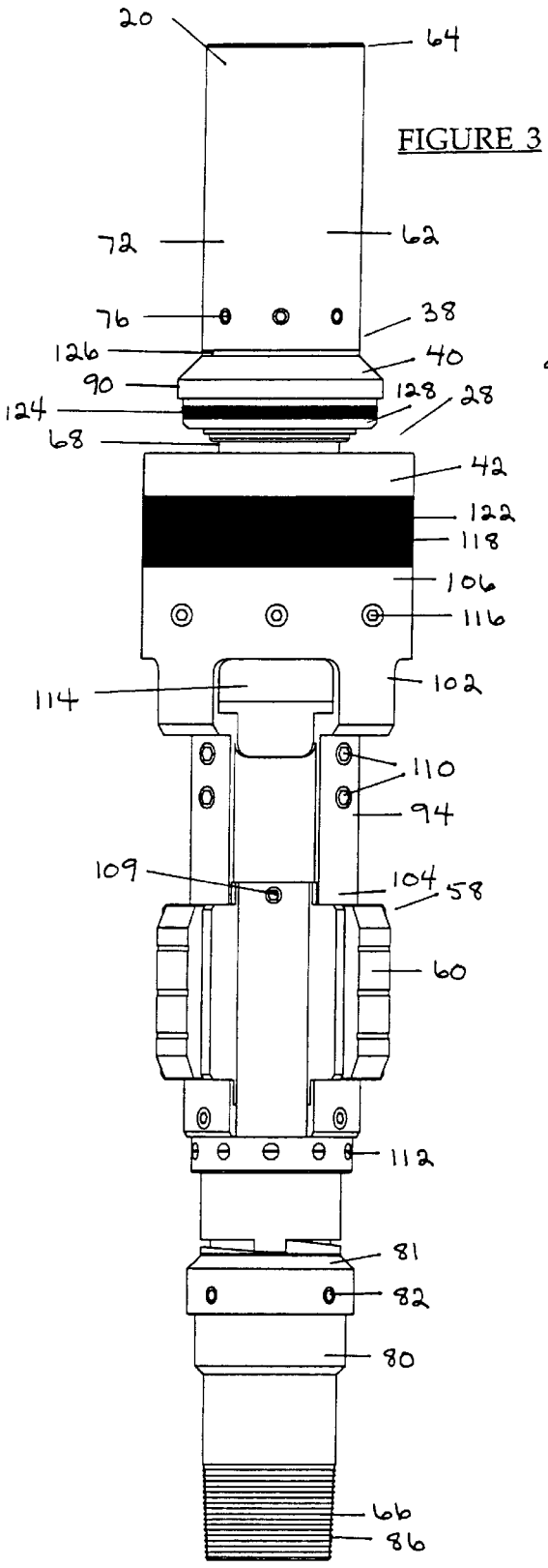
FIG. 3 is a plan view of the packer valve shown in FIG. 2(*b*) in the open flow position.
Figure 4:
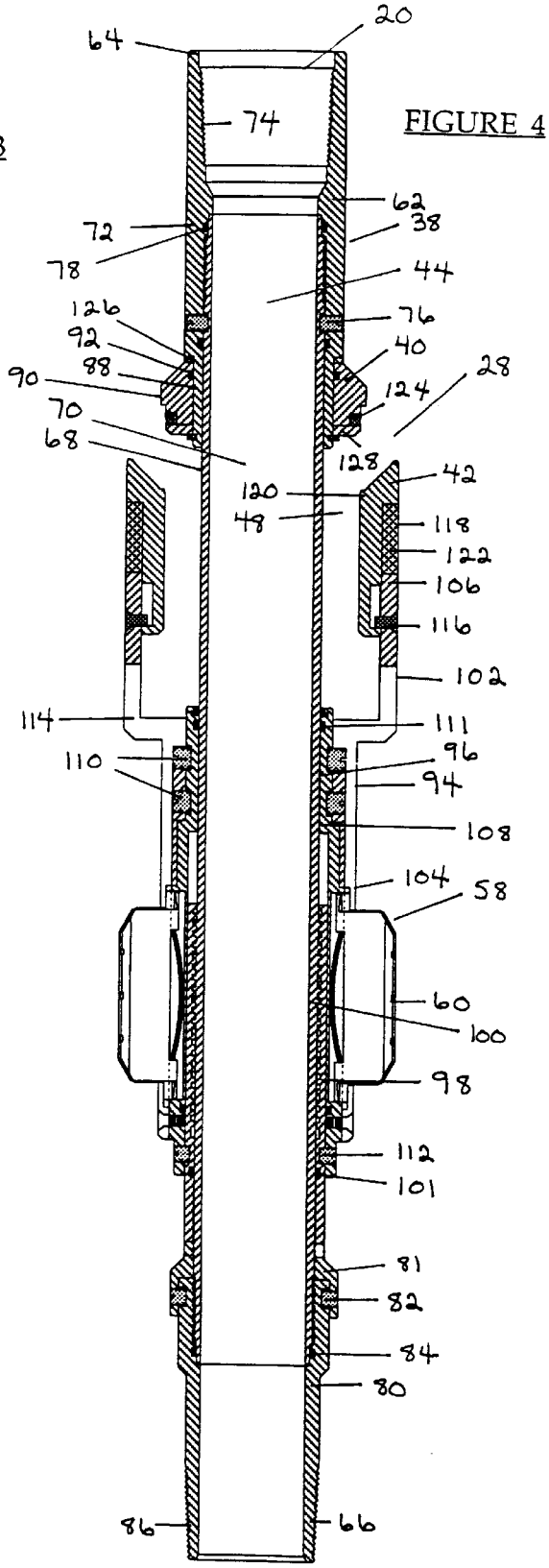
FIG. 4 is a longitudinal sectional view of the packer valve shown in FIG. 3 in the open flow position.
Figure 5A:
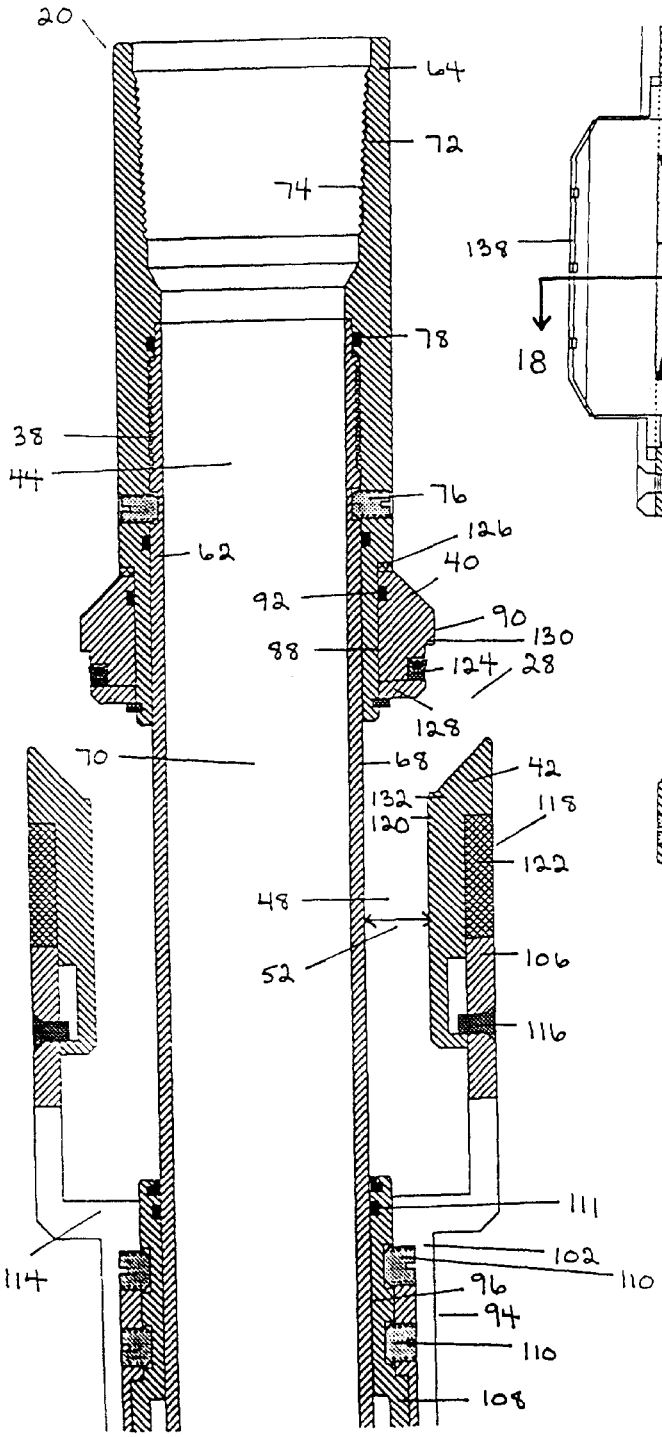
FIGS. 5(*a*) and 5(*b*) are detailed longitudinal sectional views of the packer valve shown in FIG. 4, wherein FIG. 5(*b*) is a lower continuation of FIG. 5(*a*)
Figure 5B:
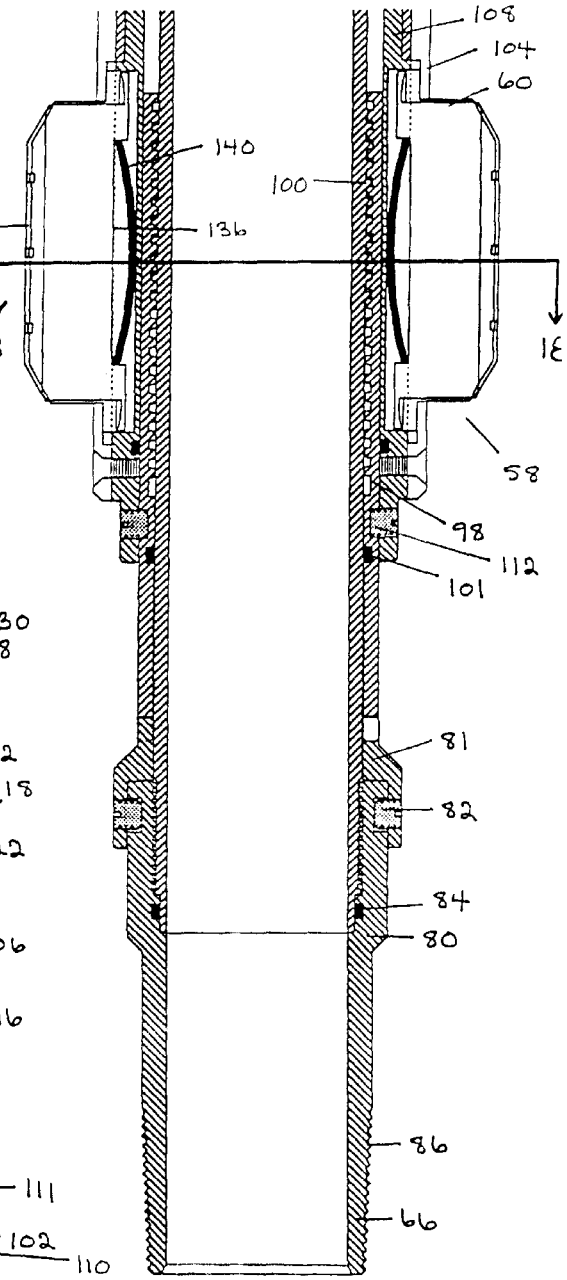
Figure 6:
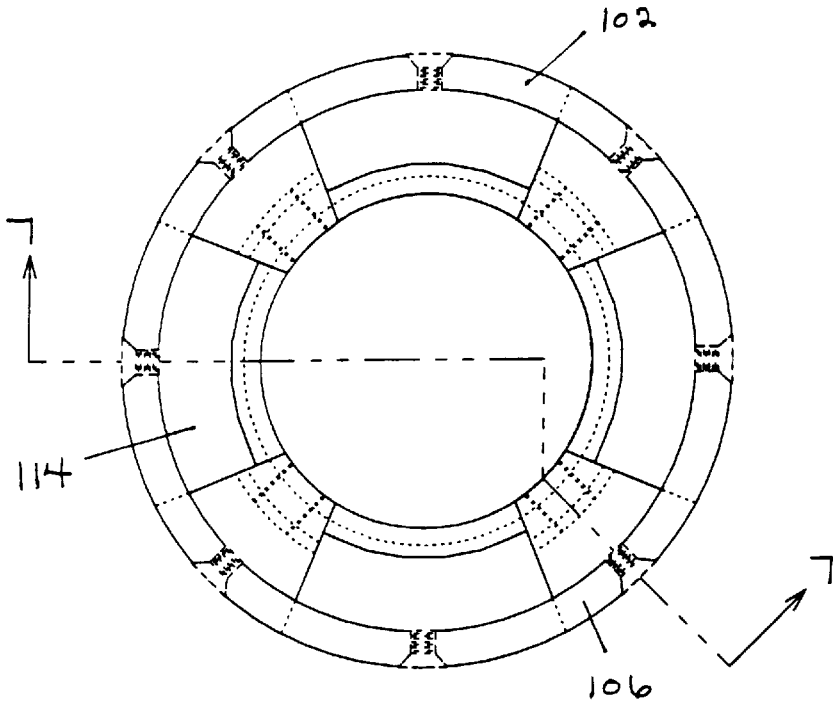
FIG. 6 is a top view of a valve cup comprising the packer valve shown in FIG. 4.
Figure 7:
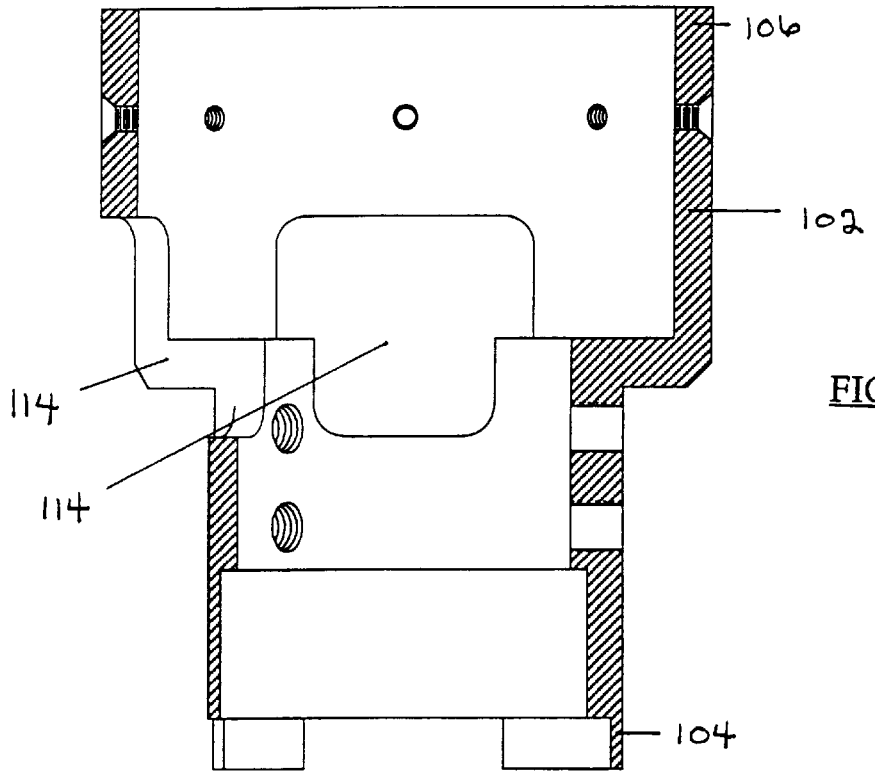
FIG. 7 is a longitudinal sectional view of the valve cup taken along line 7—7 of FIG. 6.
Figure 18:
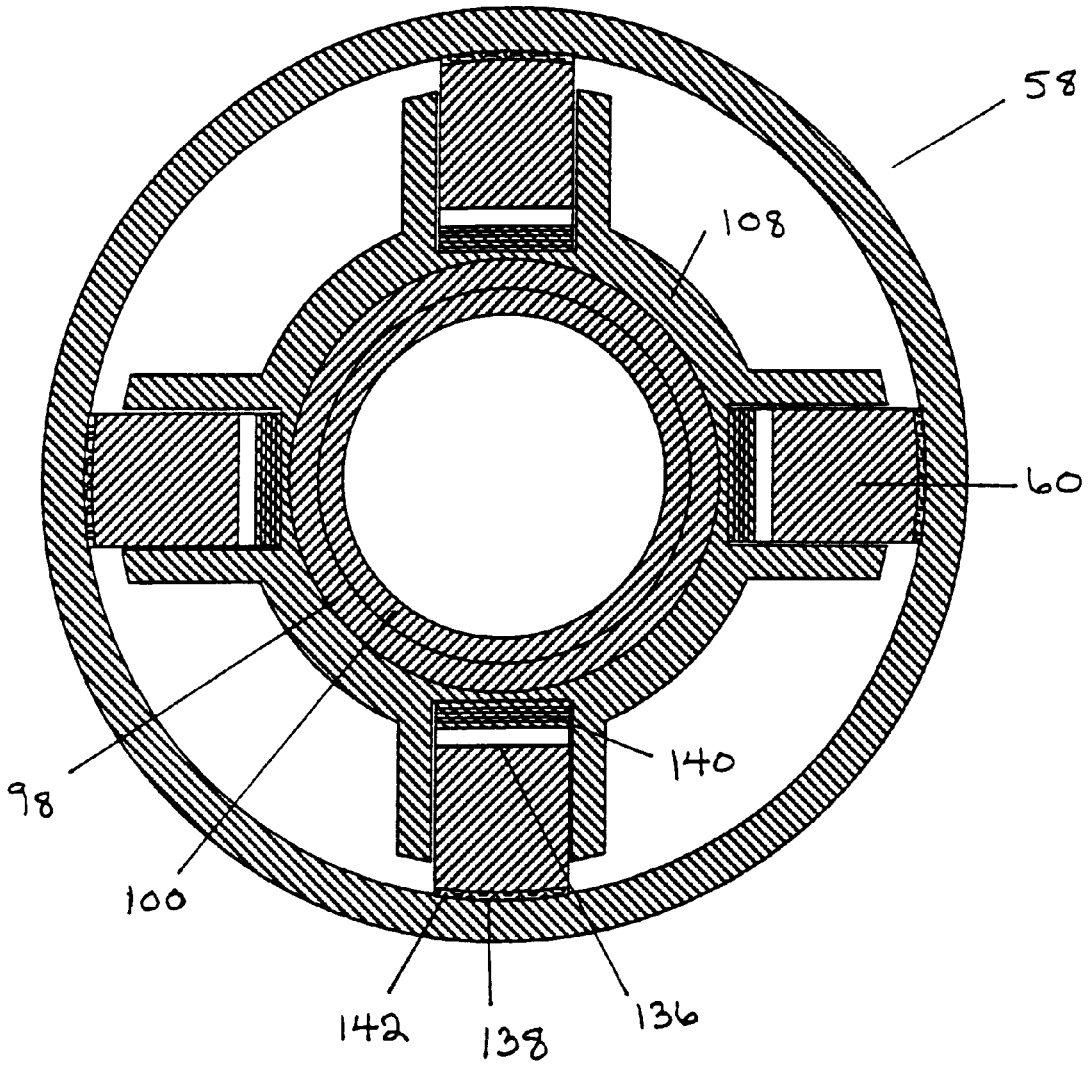
FIG. 18 is a cross-sectional view of a preferred embodiment of a drag member of the apparatus taken along line 18—18 of FIG. 5(*b*)
Figure 19A:
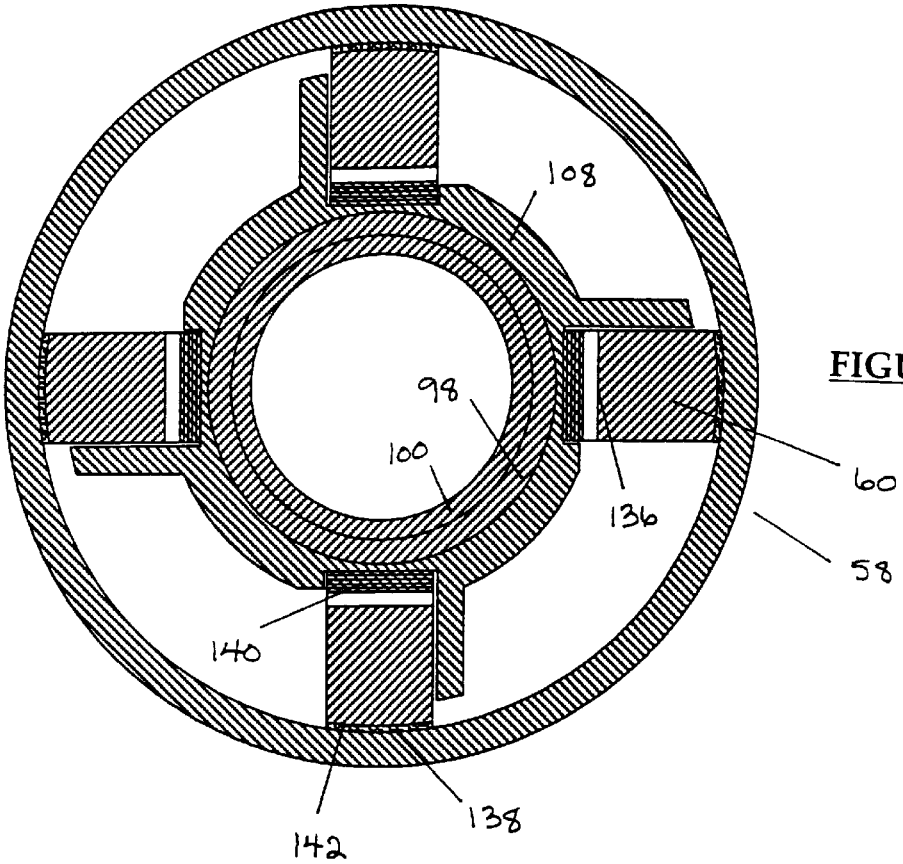
FIGS. 19(*a*) and 19(*b*) are cross-sectional views of an alternate embodiment of the drag member shown in sliding and binding positions respectively.
Figure 19B:
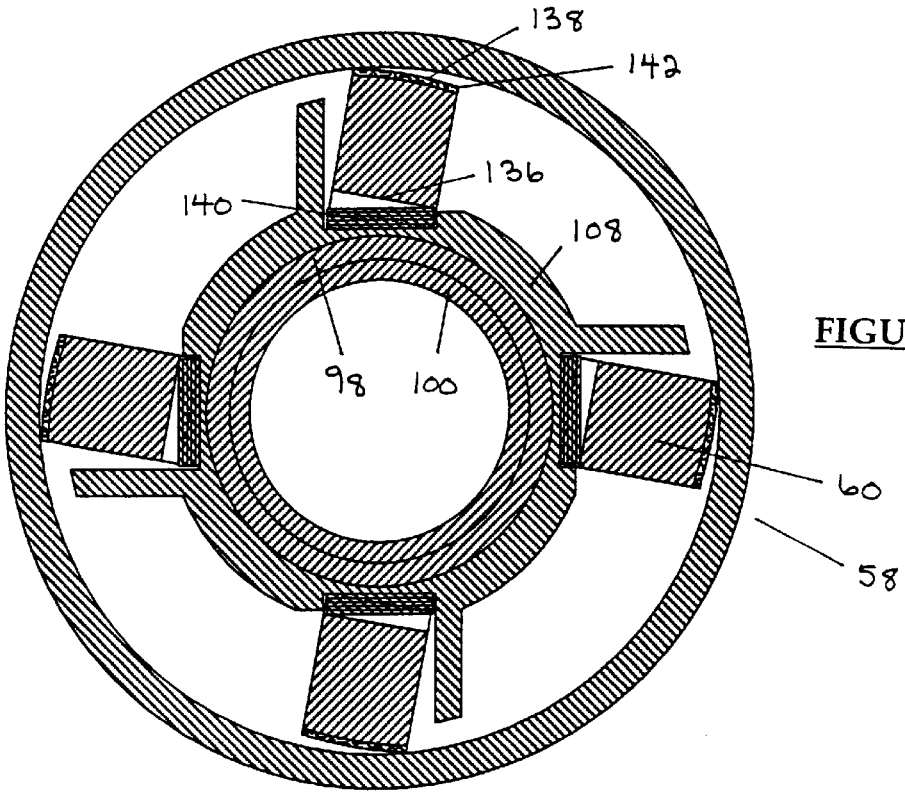

As indicated, in the preferred embodiment, the drag member (58) of the apparatus (20) is associated with the outer packing member (42). Further, the drag member (58) is comprised of one or more drag blocks (60). Referring to FIGS. 18 and 19(*a*) and (*b*), the drag member (58) is preferably comprised of four drag blocks (60) equidistantly spaced about the packer sleeve (94). However, referring to FIGS. 22(*a*) and (*b*), in an alternate embodiment, the drag member (58) is comprised of three drag blocks (60) equidistantly spaced about the packer sleeve (94). More particularly, the drag body (108) comprises the packer sleeve (94) and is mounted with the inner threaded portion (98) and the valve cup (102) by one or more fasteners. The drag blocks (60) extend from the drag body (108) radially outwardly for engagement with the wellbore (24). In order to facilitate the assembly of the drag body (108) with the inner threaded portion (98), the drag body (108) includes a bleed plug (109), as shown in FIG. 3, to permit the release of trapped air.

In addition, the drag body (108) preferably sealingly engages the packer mandrel (62). The sealing may be accomplished by any sealing mechanism or structure, such as one or more O-rings (111). In this case, the O-ring (111) slides to permit relative axial movement and rotation between the packer mandrel (62) and the drag body (108). Further, the O-ring (111) between the packer mandrel (62) and the drag body (108) is about the same diameter as the O-ring (101) between the inner threaded portion (98) of the packer sleeve (94) and the outer threaded portion (100) of the packer mandrel (62) so that there is no increase or decrease of volume in the area in-between once the apparatus (20) is assembled.

In particular, each drag block (60) has an inner surface (136) and an outer surface (138) for engaging the wellbore (24). The drag block (60) is biased radially outwardly such that the outer surface (138) engages the wellbore (24) to inhibit the rotation of the packer sleeve (94), and thus the outer packing member (42) within the wellbore (24). Preferably, at least one spring (140) is associated with the inner surface (136) of each drag block (60) for urging the drag block (60) outwardly.

In addition, the outer surface (138) of each drag block (60) is preferably comprised of a material, or coated with a material, for increasing the friction between the outer surface (138) and the adjacent wellbore (24) as shown in FIGS. 18 and 19(*a*) and (*b*). In the preferred embodiment, the outer surface (138) is comprised of a coating of tungsten carbide (142). Although any suitable thickness of coating (142) may be used, the coating (142) is preferably comprised of a 0.06 inches layer of 10×18 mesh tungsten carbide material. The tungsten carbide is preferably gas welded to the outer surface (138) of the drag block (60) with a nickel-silver tinning material. The tungsten carbide provides a sandpaper like surface to the drag block (60) so that the drag block (60) grips the adjacent wellbore (24) better.

Figure 22A:
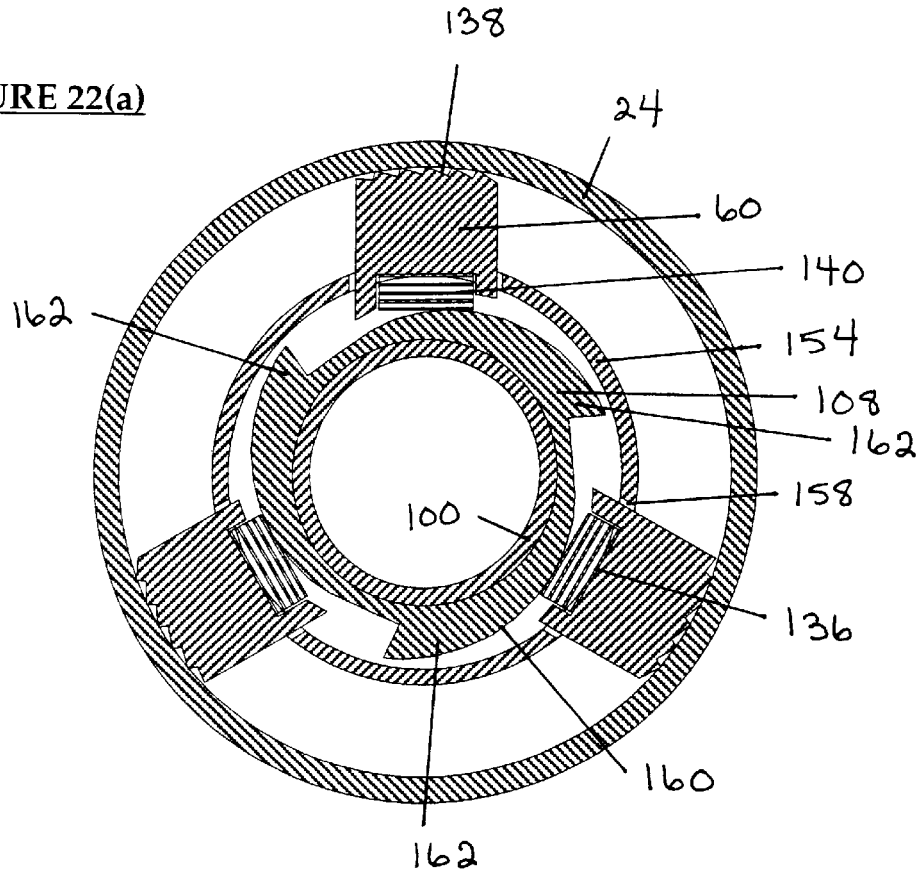
FIGS. 22(*a*) and (*b*) are cross-sectional views of the further alternate embodiment of the drag member taken along line 22—22 of FIG. 21.
Figure 22B:
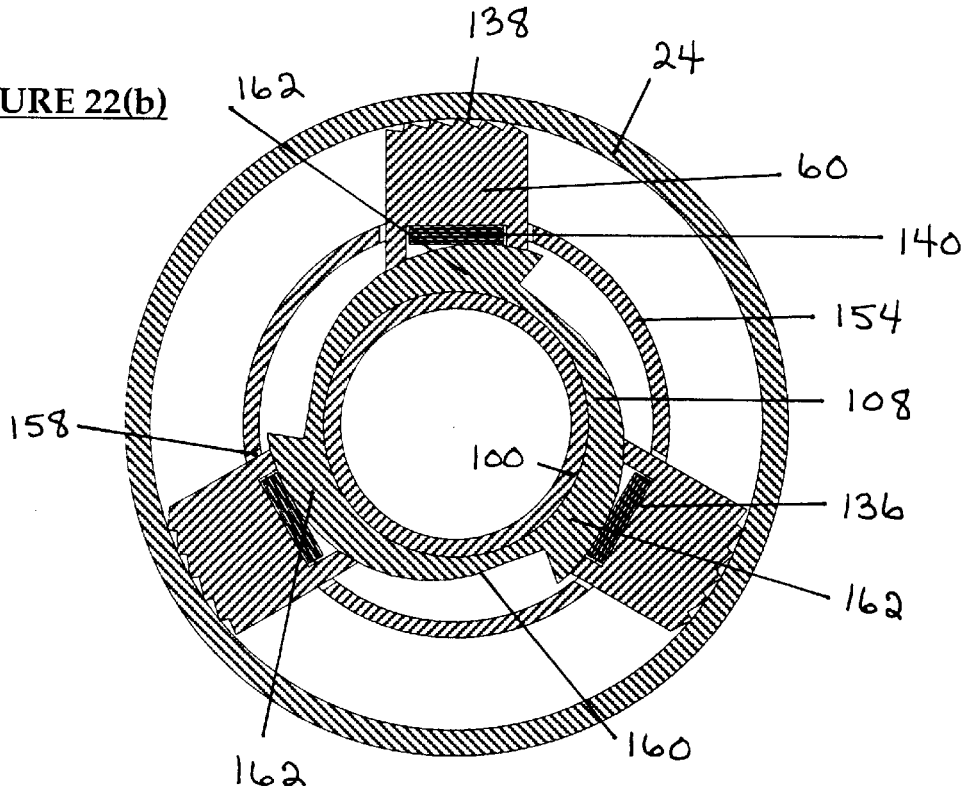

Alternately, as shown in FIGS. 22(*a*) and (*b*), the outer surface (138) of each drag block (60) may be shaped or configured to engage or grip the adjacent wellbore (24) or to otherwise increase the friction between the outer surface (138) and the adjacent wellbore (24). For example, the outer surface (138) may be comprised of a plurality of teeth for engaging the adjacent wellbore (24) and inhibiting rotation within the wellbore (24).

In the preferred embodiment for the packer-type valve, each drag block (60) is preferably pivotable between a sliding position, as shown in FIG. 19(*a*), and a binding position, as shown in FIG. 19(*b*), upon rotation of the inner packing member (40) relative to the outer packing member (42). In particular, upon rotation of the inner packing member (40) relative to the outer packing member (42) in the first direction, the drag block (60) is pivoted to the binding position to prevent rotation of the outer packing member (42) within the wellbore (24). In the binding position, a higher torque may be applied, which permits a harder elastomer to be used for the outer packing member (42). Harder elastomers resist extrusion better in the closed flow position and when heat and steam are applied. In the sliding position, the drag blocks (60) will resist rotation, but will slide when a certain amount of torque is applied.

Figure 20:
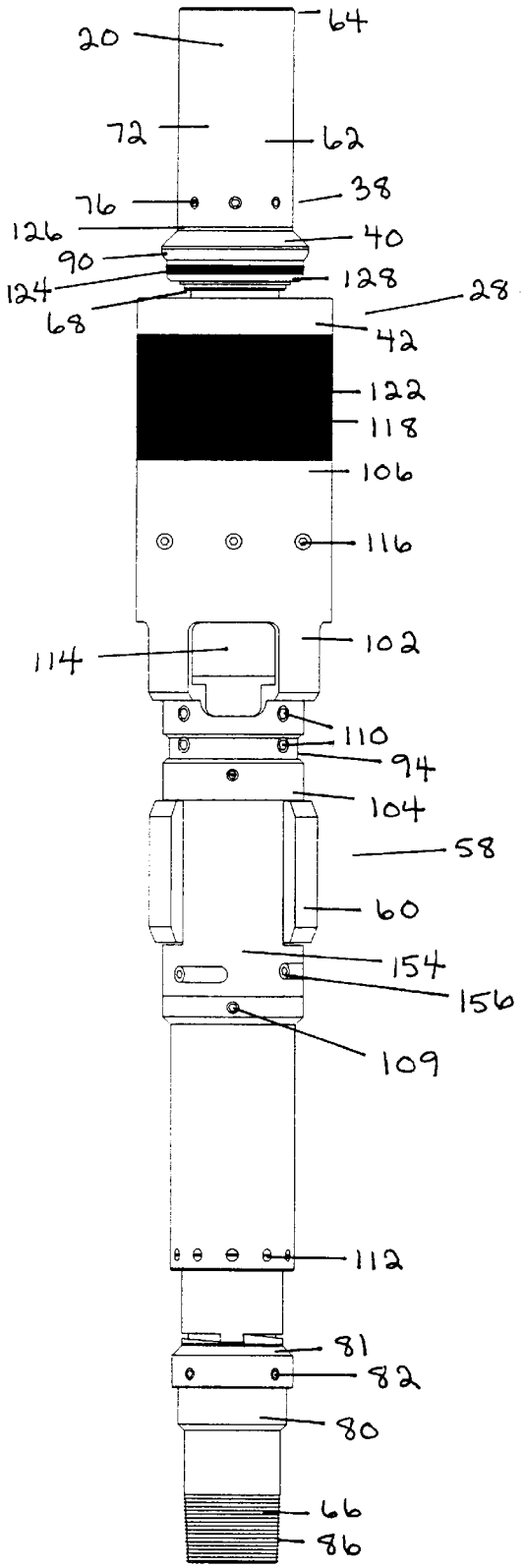
FIG. 20 is a plan view of the alternate embodiment of the packer valve shown in FIG. 9(*a*) in the open flow position and including a further alternate embodiment of the drag member.
Figure 21:
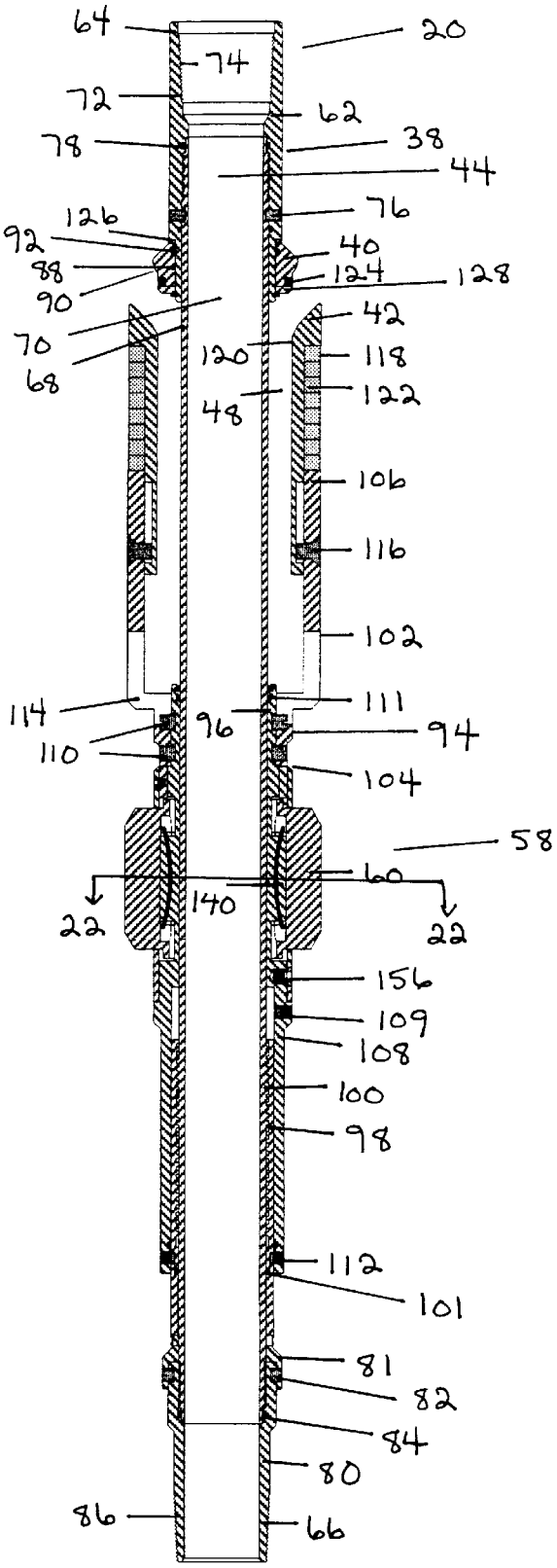
FIG. 21 is a longitudinal sectional view of the packer valve shown in FIG. 20 in the open flow position.

In an alternate embodiment of the drag member (58) as shown in FIGS. 20–22, the drag member (58) is comprised of a cage (154) for retaining or maintaining the drag blocks (60) in a desired position for engagement with the wellbore (24). The cage (154) may form part, or be integral with, the drag body (108) or it may be comprised of a separate unit, member or component affixed, attached or otherwise mounted with the drag body (108). In this event, the cage (154) may be comprised of any structure, element, apparatus or device capable of retaining the drag block (60) within the drag member (58) in the desired position relative to the drag body (108). Preferably, as shown in FIG. 21, the cage (154) is mounted with the drag body (108) by one or more set screws (156).

In addition, the cage (154) defines one or more apertures (158) therein for the passage of a drag block (60) therethrough. In other words, one aperture (158) is preferably provided for each drag block (60), wherein the drag block (60) extends from its inner surface (136), from within the cage (154), through the aperture (158) to its outer surface (138), exterior to the cage (154), for engagement with the wellbore (24).

Further, in this alternate embodiment, the drag body (108) is comprised of an outer camming surface (158). More particularly, the camming surface (160) is housed or contained, at least in part, within the cage (154) such that the camming surface (160) is positioned for contact with the drag blocks (60). Further, the camming surface (160) is shaped or configured such that a cam (162) is provided adjacent to the inner surface (136) of each drag block (60). Thus, referring to FIGS. 22(*a*) and (*b*), three cams (162) are provided for the three drag blocks (60). Each cam (162) defines a radial dimension which is variable such that the radial dimension of each cam (162) preferably increases in a right or clockwise direction when viewed from above as shown in FIGS. 22(*a*) and (*b*).

The inner surface (136) of each drag block (60) may directly contact or engage the outer camming surface (160) of each cam (162) of the drag body (108). However, preferably at least one spring (140) is located between the outer camming surface (160) and the adjacent inner surface (136) of each drag block (60) such that the spring (140) urges the drag block (60) radially outwardly for engagement with the wellbore (24). As a result, at all times, the drag blocks (60) are urged radially outwardly for engagement with the wellbore (24) to resist rotation of the drag block (60) within the wellbore (24), and thus, rotation of the outer packing member (42) in the wellbore (24).

However, referring to FIG. 22(*b*), upon rotation of the tubing string (22) in the first direction, or upon rotation of the inner packing member (40) relative to the outer packing member (42) in the first direction, the drag body (108) including each cam (162) rotates relative to the drag block (60) in the first direction. As a result, the inner surface (136) of the drag block (60) is caused to move along the camming surface (160) of each cam (162) in the direction of the increasing radial dimension of the adjacent cam (162). The increasing radial dimension of-the cam (162) causes the drag block (60) to be moved radially outwardly and therefore causes the outer surface (138) of the drag block (60) to move into a closer, firmer or more secure engagement or contact with the wellbore (24). Thus, as in the preferred embodiment, a higher torque may be applied.

Conversely, referring to FIG. 22(*a*), upon rotation of the tubing string (22) in the opposed second direction, or upon rotation of the inner packing member (40) relative to the outer packing member (42) in the opposed second direction, the drag body (108) including each cam (162) rotates relative to the drag block (60) in the second direction. As a result, the inner surface (136) of the drag block (60) is caused to move along the camming surface (160) of each cam (162) in the direction of the decreasing radial dimension of the cam (162) which permits the drag block (60) to be moved radially inwardly. In this position, the outer surface (138) of the drag block (60) continues to be urged into contact with the wellbore (24) by the spring (140) to resist rotation, however, the drag block (60) will be permitted to slide or rotate therein when a certain amount of torque is applied.

As indicated, in the straddle application, the apparatus (20) is comprised of two packer valves (28), being the upper and lower packer valves (32, 34), connected together in series with the tubing valve (30) such that the tubing valve (30) is located therebetween. Rotation of the tubing string (22) in the first direction causes each of the packer valves (32, 34) to move towards the closed flow position and rotation of the tubing string (22) in the second direction causes each of the packer valves (32, 34) to move towards the open flow position. Actuation of the packer valves (32, 34) to the closed flow position opens the tubing valve (30), while actuation of the packer valves (32, 34) to the open flow position closes the tubing valve (30).

Referring to FIGS. 12(*b*), 14 and 15, the apparatus (20) further comprises the tubing valve (30) for permitting fluid to flow between the longitudinal bore (70) of the packer mandrel (62) and the wellbore annulus (26). The tubing valve (30) may be comprised of a separate element or component mounted with the packer mandrel (62) and the packer sleeve (94). However, preferably, the tubing valve (30) is integral with the packer mandrel (62) and the packer sleeve (94) such that it forms a single unit with the packer valve (28), preferably with the upper packer valve (32). In the preferred embodiment, axial movement of the packer mandrel (62) relative to the packer sleeve (94) to the closed flow position opens the tubing valve (30) to permit the passage of fluid therethrough and axial movement of the packer mandrel (62) relative to the packer sleeve (94) to the open flow position closes the tubing valve (30) to prevent or restrict the passage of fluid therethrough.

In the preferred embodiment, the tubing valve (30) is comprised of a tubing mandrel (144) and a tubing sleeve (146). The tubing mandrel (144) is integral with, and forms part of, the lower end (66) of the packer mandrel (62) and is preferably located above the bottom coupling (80). Similarly, the tubing sleeve (146) is integral with, and forms part of, the packer sleeve (94) and in particular, the inner threaded portion (98) of the packer sleeve (94).

Thus, the tubing mandrel (144) has a longitudinal bore (148) extending therethrough. The tubing mandrel (144) is connected with, or forms part of, the packer mandrel (62) such that the longitudinal bore (148) of the tubing mandrel (144) communicates with, and is a lower continuation of, the longitudinal bore (70) of the packer mandrel (62). Further, the tubing mandrel (144) is connected with, or forms part of, the packer mandrel (62) such that axial movement of the packer mandrel (62) causes axial movement of the tubing mandrel (144). Finally, the tubing mandrel (144) defines at least one mandrel aperture (150) therethrough for the passage of fluid from the longitudinal bore (148).

The tubing sleeve (146) is mounted about the tubing mandrel (144) by the structure by which the packer sleeve (94) is mounted about the packer mandrel (62). Thus, the tubing sleeve (146) is mounted such that the tubing mandrel (144) is movable axially relative to the tubing sleeve (146). Further, the tubing sleeve (146) is connected to, or forms part of, the packer sleeve (94) such that axial movement of the packer sleeve (94) causes axial movement of the tubing sleeve (146). Finally, the tubing sleeve (146) defines at least one sleeve aperture (152) therethrough for the passage of fluid.

The sleeve aperture (152) is communicable with the mandrel aperture (150) upon the axial alignment of the mandrel aperture (150) and the sleeve aperture (152). More particularly, movement of the packer valves (32, 34) towards the closed flow position axially aligns the mandrel aperture (150) and the sleeve aperture (152) to permit the passage of fluid therethrough. Movement of the packer valves (32, 34) towards the open flow position axially misaligns the mandrel aperture (150) and the sleeve aperture (152) to inhibit the passage of fluid therethrough.

The within invention further relates to a method for regulating the flow of a fluid in the wellbore (24) within the wellbore annulus (26) between the tubing string (22) and the wellbore (24). The method is preferably performed using the apparatus (20) as described above, however, any compatible apparatus permitting the performance of the steps of the method may be used.

In one embodiment, the method comprises the step of suspending the tubing string (22) in the wellbore (24). The tubing string (22) may be suspended by any structure, device or method for suspending the tubing string (22). However, preferably, the tubing string (22) is suspended by the tubing rotator (36) as described previously.

Next, at least one packer valve (28) is connected with the tubing string (22), wherein the packer valve (28) is actuatable through rotation of the tubing string (22) between a closed flow position wherein the packer valve (28) substantially seals the wellbore annulus (26) and an open flow position wherein the flow of the fluid is permitted through the wellbore annulus (26). The packer valve (28), the closed flow position and the open flow position are all preferably as described above.

Finally, the tubing string (22) is rotated in the first direction, as described above, to actuate the packer valve (28) to the closed flow position. The tubing string (22) may be rotated by any mechanism, structure, device or method capable of rotating the tubing string (22) in the required manner. However, preferably, the tubing string (22) is rotated by the tubing rotator (36).

Where it is desirable that the packer valve (28) be actuated back to the open flow position, the method may be further comprised of the step of rotating the tubing string (22) in a second opposed direction, as described previously, to actuate the packer valve (28) to the open flow position. Again, preferably, the tubing string (22) is rotated by the tubing rotator (36).

In a further embodiment of the method, the method comprises the step of providing at least one packer valve (28) comprising the packer body (38), the inner packing member (40) and the outer packing member (42), all preferably as described above for the apparatus (20). The packer body (38) is connected with the tubing string (22) such that the packer body (38) is manipulable through manipulation of the tubing string(22). The inner packing member (40) is associated with the packer body (38) and the outer packing member (42) is mounted with the packer body (38) as described previously.

The method further comprises the step of first moving the inner packing member (40) axially towards the outer packing member (42) to the closed flow position wherein the outer packing member (42) is engaged with the inner packing member (40) and the wellbore (24) to substantially seal the outer annular space (46) and the inner annular space (48).

Where it is desirable that the packer valve (28) be actuated back to the open flow position, the method further comprises the step of second moving the inner packing member (40) axially away from the outer packing member (42) to the open flow position wherein the outer packing member (42) is disengaged from at least the inner packing member (40) and the outer annular space (46) communicates with the inner annular space (48) to permit the flow of the fluid through the outer annular space (46) and the inner annular space (48).

As discussed for the apparatus (20), the inner packing member (40) may be moved axially towards and away from the outer packing member (42) by any mechanism, structure or device and by any manner or method capable of providing the relative axial movement. For instance, the moving steps may include axially or longitudinally moving the tubing string (22) or axially moving the tubing string (22) in combination with a rotary movement. However, in the preferred embodiment, the moving steps are performed by rotating the tubing string (22) to rotate the inner packing member (40) relative to the outer packing member (42) and translating the rotation into relative axial movement of the inner and outer packing members (40, 42).

In particular, the first moving step is preferably comprised of rotating the tubing string (22) in the first direction to rotate the inner packing member (40) in the first direction relative to the outer packing member (42) and translating the rotation of the inner packing member (40) relative to the outer packing member (42) into axial movement of the inner packing member (40) relative to the outer packing member (42) towards the closed flow position. The second moving step is preferably comprised of rotating the tubing string (22) in the second direction to rotate the inner packing member (40) in the second direction relative to the outer packing member (42) and translating the rotation of the inner packing member (40) relative to the outer packing member (42) into axial movement of the inner packing member (40) relative to the outer packing member (42) towards the open flow position.

As discussed for the apparatus (20), in order to assist or facilitate the relative rotational movement, the method preferably further comprises the step of inhibiting the rotation of the outer packing member (42) within the wellbore (24) during rotation of the tubing string (22) in the first direction or the second direction to facilitate rotation of the inner packing member (40) relative to the outer packing member (42). The rotation may be inhibited by any mechanism, structure. device or method capable of inhibiting the rotation of the outer packing member (42) within the wellbore (24), as discussed previously.

Further, where the method is being used for steam injection of an intermediate zone or lower zone of the formation, the method may further include providing a tubing valve (30), as described above, for permitting fluid to flow between the longitudinal bore (44) of the packer body (38) and the wellbore annulus (26). The tubing valve (30) is opened to permit the flow of the fluid therethrough upon movement of the packer valve (28) to the closed flow position. The tubing valve (30) is closed to inhibit the passage of the fluid therethrough upon movement of the packer valve (28) to the open flow position.

Finally, where the method is being used for steam injection of an intermediate zone of the formation, the method may comprise providing two packer valves (32, 34) connected together in series with the tubing valve (30) such that the tubing valve (30) is located therebetween. Rotating the tubing string (22) in the first direction causes each of the packer valves (32, 34) to move towards the closed flow position and rotating the tubing string (22) in the second direction causes each of the packer valves (32, 34) to move towards the open flow position.

The embodiments of the invention in which an exclusive privilege or property is claimed are defined as follows:

1. A packer valve for connection with a tubing string for use in a wellbore for regulating the flow of fluid within a wellbore annulus between the tubing string and the wellbore, the packer valve comprising:

a packer body for fixed interconnection with the tubing string such that the packer body is manipulable through manipulation of the tubing string, the packer body having a longitudinal bore extending therethrough for communication with the tubing string;

a inner packing member carried by and extending radially outward from the packer body, the inner packing member defining an outer annular flow path radially between the inner packing member and the wellbore when the packer valve is in the wellbore;

an outer packing member carried by the packer body, the outer packing member defining an inner annular flow path radially between the packer body and the outer packing member;

one of the packing members being axially moveable relative to the other packing member between a closed flow position wherein the outer packing member is engaged with the inner packing member and the wellbore and an open flow position wherein the outer packing member is disengaged from the inner packing member; and the outer annular flow path being in fluid communication with the inner annular flow path for transmitting a majority of fluid in the wellbore annulus through both the outer annular flow path and the inner annular flow path when the packer valve is in the open flow position.

2. The packer valve as defined in claim 1, wherein the outer annular flow path defined by the inner packing member is substantially unobstructed to fluid flow between the wellbore and the inner packing member, and the inner annular flow path defined by the outer packing member is substantially unobstructed to fluid flow between the packer body and the outer packing member.

3. The packer valve as defined in claim 1, wherein a radial spacing between the inner packing member and wellbore is about equal to a radial spacing between the packer body and the outer packing member.

4. The packer valve as defined in claim 1, further comprising:

an outer packing member valve cup supported by the packer body and supporting thereon the outer packing member, the valve cup including a plurality of circumferentially spaced flow ports for fluid communication between the annulus and the inner annular flow path defined by the outer packing member.

5. The packer valve as defined in claim 1, further comprising:

a packer sleeve mounted about the packer body such that rotation of the packer body relative to the packer sleeve is translated into axial movement of the one packing member relative to the other packing member, an outer surface of the packer body including an outer thread, and an inner surface of the packer sleeve including a mating inner thread, such that rotation of the tubing string moves the packer valve between the closed flow position and the open flow position.

6. The packer valve as defined in claim 5, further comprising:

a through port in the packer body; and the packer sleeve including a sealing member forming a tubing valve for sealing engagement with the packer body, such that rotation of the packer sleeve relative to the packer body opens the tubing valve between the packer body bore and the wellbore annulus when the packer valve is in the closed flow position and the tubing valve is closed when the packer valve is in open flow position.

7. The packer valve as defined in claim 6, wherein the packer sleeve includes a through aperture in fluid communication with the through port in the packer body when the tubing valve is in the open flow position.

8. The packer valve as defined in claim 6, further comprising:

a pair of axially spaced packer valves connected together in series with the tubing valve located therebetween, wherein rotation of the tubing string in the first direction causes each of the pair of the packer valves to move to the closed flow position while the tubing valve is moved towards an open position and rotation of the tubing string in the second direction causes each of the packer valves to move to the open flow position while the tubing valve is moved towards a closed position.

9. The packer valve as defined in claim 5, wherein the packer sleeve is rotationally secured to the outer packing member, and the inner packing member is rotationally secured to the packer body.

10. The packer valve is defined in claim 1, further comprising:

a drag member for engaging the wellbore to inhibit rotation of the outer packing member upon rotation of the tubing string and the inner packing member, the drag member being selectively engageable with a wall of the wellbore in response to rotation of the tubing string without axial movement of the tubing string.

11. The packer valve as defined in claim 10, when the drag member includes a plurality of drag blocks each pivotable with respect to the packer body to a binding position on rotation of the tubing string to prevent rotation of the outer packing member within the wellbore.

12. A packer valve for connection with a tubing string for use in a wellbore for regulating the flow of fluid within a wellbore annulus between the tubing string and the wellbore, the packer valve comprising:

a packer body for fixed interconnection with the tubing string such that the packer body is manipulable through manipulation of the tubing string, the packer body having a longitudinal bore extending therethrough for communication with the tubing string;

a inner packing member carried by and extending radially outward from the packer body, the inner packing member defining an outer annular flow path radially between the inner packing member and the wellbore when the packer valve is in the wellbore;

an outer packing member carried by the packer body, the outer packing member defining an inner annular flow path radially between the packer body and the outer packing member;

one of the packing members being axially moveable relative to the other packing member between a closed flow position wherein the outer packing member is engaged with the inner packing member and the wellbore and an open flow position wherein the outer packing member is disengaged from the inner packing member; and a packer sleeve mounted about the packer body such that rotation of the body relative to the packer sleeve is translated into axial movement of the one packing member relative to the other packing member, an outer surface of the packer body including an outer thread, and an inner surface of the packer sleeve including a mating inner thread, such that rotation of the tubing string moves the packer valve between the closed flow position and the opened flow position.

13. The packer valve as defined in claim 12, further comprising:

a through port in the packer body; and the packer sleeve including a sealing member forming a tubing valve for sealing engagement with the packer body, such that rotation of the packer sleeve relative to the packer body opens the tubing valve between the packer body bore and the wellbore annulus when the packer valve is in the closed flow position and the tubing valve is closed when the packer valve is in open flow position.

14. The packer valve as defined in claim 12, wherein the packer sleeve is rotationally secured to the outer packing member, and the inner packing member is rotationally secured to the packer body.

15. The packer valve as defined in claim 12, further comprising:

a pair of axially spaced packer valves connected together in series with the tubing valve located therebetween, wherein rotation of the tubing string in the first direction causes each of the pair of the packer valves to move to the closed flow position while the tubing valve is moved towards an open position and rotation of the tubing string in the second direction causes each of the packer valves to move to the open flow position while the tubing valve is moved towards a closed position.

16. The packer valve as defined in claim 12, wherein the outer annular flow path defined by the inner packing member is substantially unobstructed to fluid flow between the wellbore and the inner packing member, and the inner annular flow path defined by the outer packing member is substantially unobstructed to fluid flow between the packer body and the outer packing member.

17. The packer valve as defined in claim 12, wherein a radial spacing between the inner packing member and wellbore is about equal to a radial spacing between the packer body and the outer packing member.

18. The packer valve as defined in claim 12, further comprising:

a drag member for engaging the wellbore to inhibit rotation of the outer packing member upon rotation of the tubing string and the inner packing member, the drag member being selectively engageable with a wall of the wellbore in response to rotation of the tubing string without axial movement of the tubing string; and the drag member including a plurality of drag blocks each pivotable with respect to the packer body to a binding position on rotation of the tubing string to prevent rotation of the outer packing member within the wellbore.

19. A method of controlling fluid flow with a packer valve within a wellbore annulus between a tubing string and the wellbore, the method comprising:

connecting a packer body with the tubing string such that the packer body is manipulable through manipulation of the tubing string, the packer body having a longitudinal bore extending therethrough for communication with the tubing string;

supporting a inner packing member on the packer body and extending radially outward from the packer body, the inner packing member defining an outer annular flow path radially between the inner packing member and the wellbore when the packer valve is in the wellbore;

supporting an outer packing member on the packer body, the outer packing member defining an inner annular flow path radially between the packer body and the outer packing member;

axially moving one packing member relative the other packing member by rotating the tubing string between a closed flow position wherein the outer packing member is engaged with the inner packing member and the wellbore and an open flow position wherein the outer packing member is disengaged from the inner packing member; and passing a majority of fluid in the wellbore annulus through both the outer annular flow path and the inner annular flow path when the packer valve is in the open flow position.

20. The method as defined in claim 19, further comprising:

rotatably securing the inner packing member to the tubing string:

rotating the tubing string in a first direction to rotate the inner packing member in a first direction relative to the outer packing member; and translating the rotation of the tubing into axial movement of the outer packing member relative to the inner packing member towards the closed flow position.

21. The method as defined in claim 20, further comprising:

rotating the tubing string in a second direction to rotate the inner packing member in the second direction relative to the outer packing member; and translating the rotation of the tubing string into axial movement of the outer packing member relative to the inner packing member towards the open flow position.

22. The method as defined in claim 20, further comprising:

inhibiting the rotation of the outer packing member within the wellbore during rotation of the tubing string in the first direction to facilitate rotation of the inner packing member relative to the outer packing member.

23. The method as defined in claim 20, further comprising:

mounting a packer sleeve on the packer body such that threads on an outer surface of the packer body mate with threads on an inner surface of the packer sleeve, such that rotation of the tubing string moves the packer valve between the closed flow position and the open flow position.

24. The method as defined in claim 20, further comprising:

providing a through port in the packer body; and providing a sealing member on the packer sleeve to form a tubing valve for sealing engagement with the packer body, such that rotation of the packer sleeve relative to the packer body opens the tubing valve between the packer body bore and the wellbore annulus when the packer valve is in the closed flow position and the tubing valve is closed when the packer valve is in the open flow position.

25. The method as defined in claim 24, further comprising:

providing a pair of packer valves connected together in series with the tubing valve such that the tubing valve is located therebetween; and rotating the tubing string in the first direction to cause each of the packer valves to move towards the closed flow position while the tubing valve string in the second direction to cause each of the packer valves to move towards the open flow position while the tubing valve is moved towards a closed position.

26. The method as defined in claim 20, further comprising:

providing a radial spacing between the inner packing member and wellbore which is about equal to a radial spacing between the packer body and the outer packing member.

* * * * *